US008459504B2

(12) United States Patent
Braxton et al.

(10) Patent No.: US 8,459,504 B2
(45) Date of Patent: Jun. 11, 2013

(54) FOOD DISPENSING MOUTHPIECE

(76) Inventors: Paula Braxton, North Las Vegas, NV (US); Jennifer Radspinner, Beaverton, OR (US)

( * ) Notice: Subject to any disclaimer, the term of this patent is extended or adjusted under 35 U.S.C. 154(b) by 665 days.

(21) Appl. No.: 12/558,436

(22) Filed: Sep. 11, 2009

(65) Prior Publication Data

US 2010/0147885 A1 Jun. 17, 2010

Related U.S. Application Data

(60) Provisional application No. 61/096,683, filed on Sep. 12, 2008.

(51) Int. Cl.
*B65D 35/00* (2006.01)

(52) U.S. Cl.
USPC ..... 222/106; 22/192; 30/141

(58) Field of Classification Search
USPC ..... 222/106, 92, 192, 541.1, 541.5, 541.6, 222/541.9, 546, 519–521, 206–211, 93, 257, 222/258; 30/141, 123.3
See application file for complete search history.

(56) References Cited

U.S. PATENT DOCUMENTS

| | | | | | |
|---|---|---|---|---|---|
| 2,252,119 | A * | 8/1941 | Edmonds | 30/123.3 |
| D191,387 | S * | 9/1961 | Hansen | D9/436 |
| 3,133,679 | A * | 5/1964 | Brown | 222/205 |
| 3,259,132 | A * | 7/1966 | Katter | 30/324 |
| 3,931,741 | A * | 1/1976 | Ceccarelli | 73/427 |
| 4,091,965 | A * | 5/1978 | Gebhard | 222/192 |
| 4,888,188 | A * | 12/1989 | Castner et al. | 426/109 |
| 5,137,183 | A * | 8/1992 | Mikulec et al. | 222/192 |
| 5,429,282 | A * | 7/1995 | Stebick | 222/521 |
| 5,556,008 | A * | 9/1996 | Silver et al. | 222/192 |
| 5,655,685 | A * | 8/1997 | Carr et al. | 222/153.02 |
| 6,039,218 | A * | 3/2000 | Beck | 222/153.06 |
| 6,675,482 | B1 * | 1/2004 | Gilbert et al. | 30/141 |
| 6,802,423 | B2 * | 10/2004 | O'Brien | 206/541 |
| 7,374,046 | B1 * | 5/2008 | O'Brien | 206/541 |
| 7,611,025 | B2 * | 11/2009 | Nusbaum et al. | 215/253 |

* cited by examiner

*Primary Examiner* — Lien Ngo
(74) *Attorney, Agent, or Firm* — Barnes & Thornburg LLP

(57) ABSTRACT

An apparatus comprising a fitment, a neck portion, and a mouthpiece. In various embodiments, the fitment may be configured to attach the apparatus substantially permanently with a flexible pouch containing edible material. In one embodiment, the fitment may include a first hole configured to provide an exit point for the edible material from the flexible pouch. In various embodiments, the neck portion may be configured to connect the fitment and a mouthpiece portion. In one embodiment, the neck portion may include a channel configured to transmit the edible material from the hole of the fitment to the mouthpiece. In various embodiments, the mouthpiece may be configured to facilitate eating of the edible material. In one embodiment, the mouthpiece may include a concave portion configured to hold the edible material, and a second hole configured to transmit the edible material from the neck portion to the concave portion.

18 Claims, 23 Drawing Sheets

FIG. 3
300
FIG. 3a
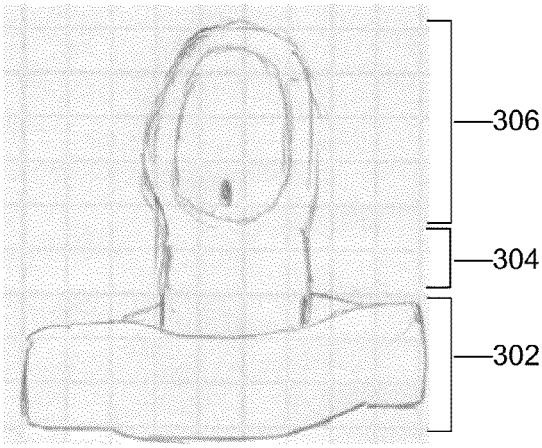
FIG. 3c
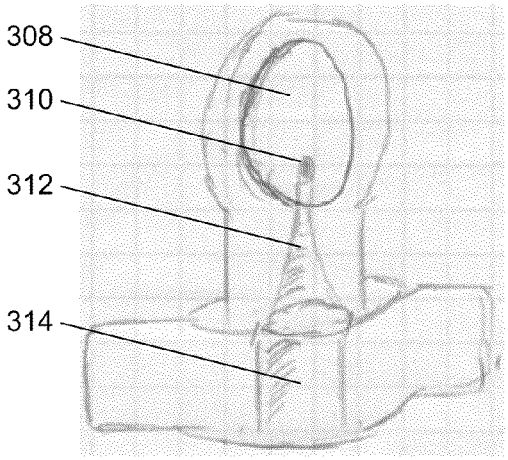
FIG. 3b
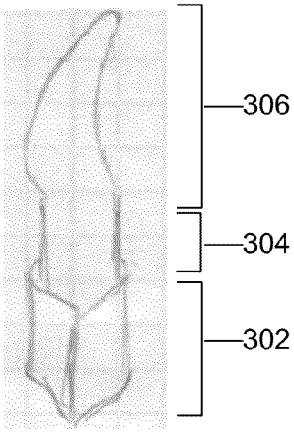
FIG. 3d
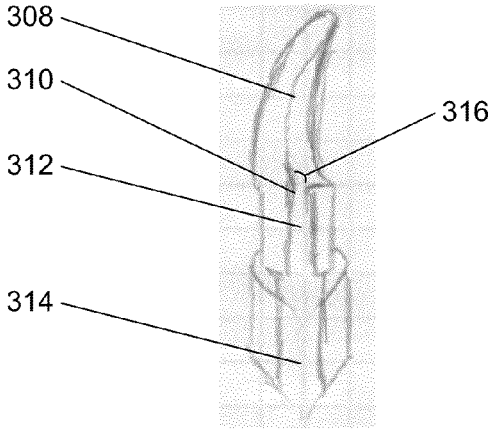

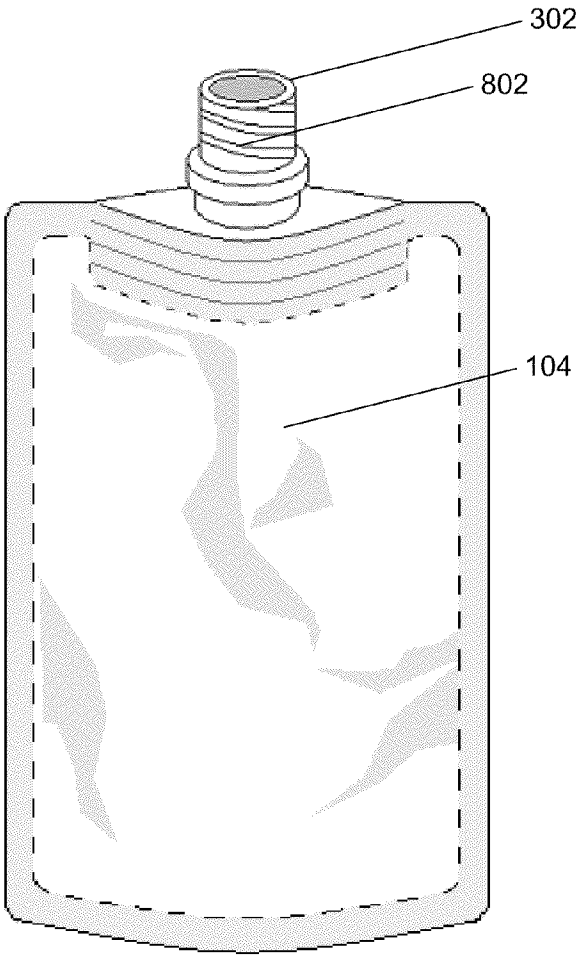
FIG. 8
800
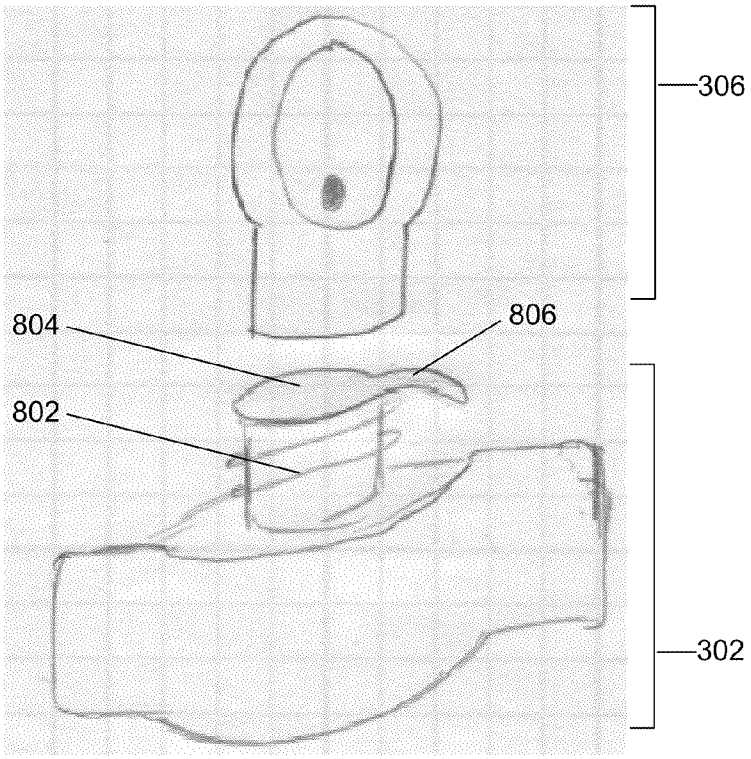

900

1000

FOOD DISPENSING MOUTHPIECE

CROSS REFERENCE TO RELATED APPLICATIONS

This application claims the benefit under 35 U.S.C. §119 (e) of U.S. Provisional Patent Application Ser. No. 61/096,683, filed on Sep. 12, 2008, the entire contents of which are incorporated by reference herein in its entirety.

TECHNICAL FIELD

This description relates to a feeding system and more specifically a mouthpiece for feeding infants or invalids.

BACKGROUND

Generally, infants or invalids are spoon feed. Often this is a two handed process in which one hand is used to hold a container of food while the other hand holds a spoon or other eating utensil. This is frequently inconvenient. For example, in the case of an infant, a third hand may be needed to hold the child. However, often performing these three actions with only two hands frequently leads to difficulty.

SUMMARY

According to one general aspect, an apparatus comprising a fitment, a neck portion, and a mouthpiece. In various embodiments, the fitment may be configured to attach the apparatus substantially permanently with a flexible pouch containing edible material. In one embodiment, the fitment may include a first hole configured to provide an exit point for the edible material from the flexible pouch. In various embodiments, the neck portion may be configured to connect the fitment and a mouthpiece portion. In one embodiment, the neck portion may include a channel configured to transmit the edible material from the hole of the fitment to the mouthpiece. In various embodiments, the mouthpiece may be configured to facilitate eating of the edible material. In one embodiment, the mouthpiece may include a concave portion configured to hold the edible material, and a second hole configured to transmit the edible material from the neck portion to the concave portion.

According to another general aspect, an apparatus comprising a fitment and a mouthpiece. In various embodiments, the fitment may be configured to attach the apparatus substantially permanently with a container configured to hold semi-liquid material. In one embodiment, the fitment may include a spout configured to discharge the semi-liquid material from the container. In various embodiments, the mouthpiece may include a tubular hole and a holding portion. In some embodiments, the tubular hole may be positioned longitudinally and configured to route the semi-liquid material from the spout to a holding portion. In some embodiments, the holding portion may be configured to hold the semi-liquid material that has been discharged from the container via the tubular hole.

According to another general aspect, a system comprising a container and a food dispensing mouthpiece. In one embodiment, the container may be configured to store fluid edible material. In various embodiments, the food dispensing mouthpiece may include a fitment and a mouthpiece portion. In some embodiments, the fitment may be configured to attach the food dispensing mouthpiece substantially permanently with the container. In various embodiments, the mouthpiece portion may include a tubular hole and a holding portion. In some embodiments, the tubular hole may be positioned longitudinally and configured to route the semi-liquid material from the container to a holding portion. In various embodiments, the holding portion may be configured to hold the semi-liquid material that has been discharged from the container.

The details of one or more implementations are set forth in the accompanying drawings and the description below. Other features will be apparent from the description and drawings, and from the claims.

A system and/or apparatus for a feeding utensil, substantially as shown in and/or described in connection with at least one of the figures, as set forth more completely in the claims.

BRIEF DESCRIPTION OF THE DRAWINGS

FIG. 3*a* is an isometric diagram of an example embodiment of an apparatus in accordance with the disclosed subject matter.

FIG. 3*b* is a side-facing diagram of an example embodiment of an apparatus in accordance with the disclosed subject matter.

FIG. 3*c* is a cross-sectional isometric diagram of an example embodiment of an apparatus in accordance with the disclosed subject matter.

FIG. 3*d* is a cross-sectional side-facing diagram of an example embodiment of an apparatus in accordance with the disclosed subject matter.

FIG. 8 is a series of diagrams of an example embodiment of a system illustrating a screw-off mouthpiece in accordance with the disclosed subject matter.

DETAILED DESCRIPTION

Figure 1:
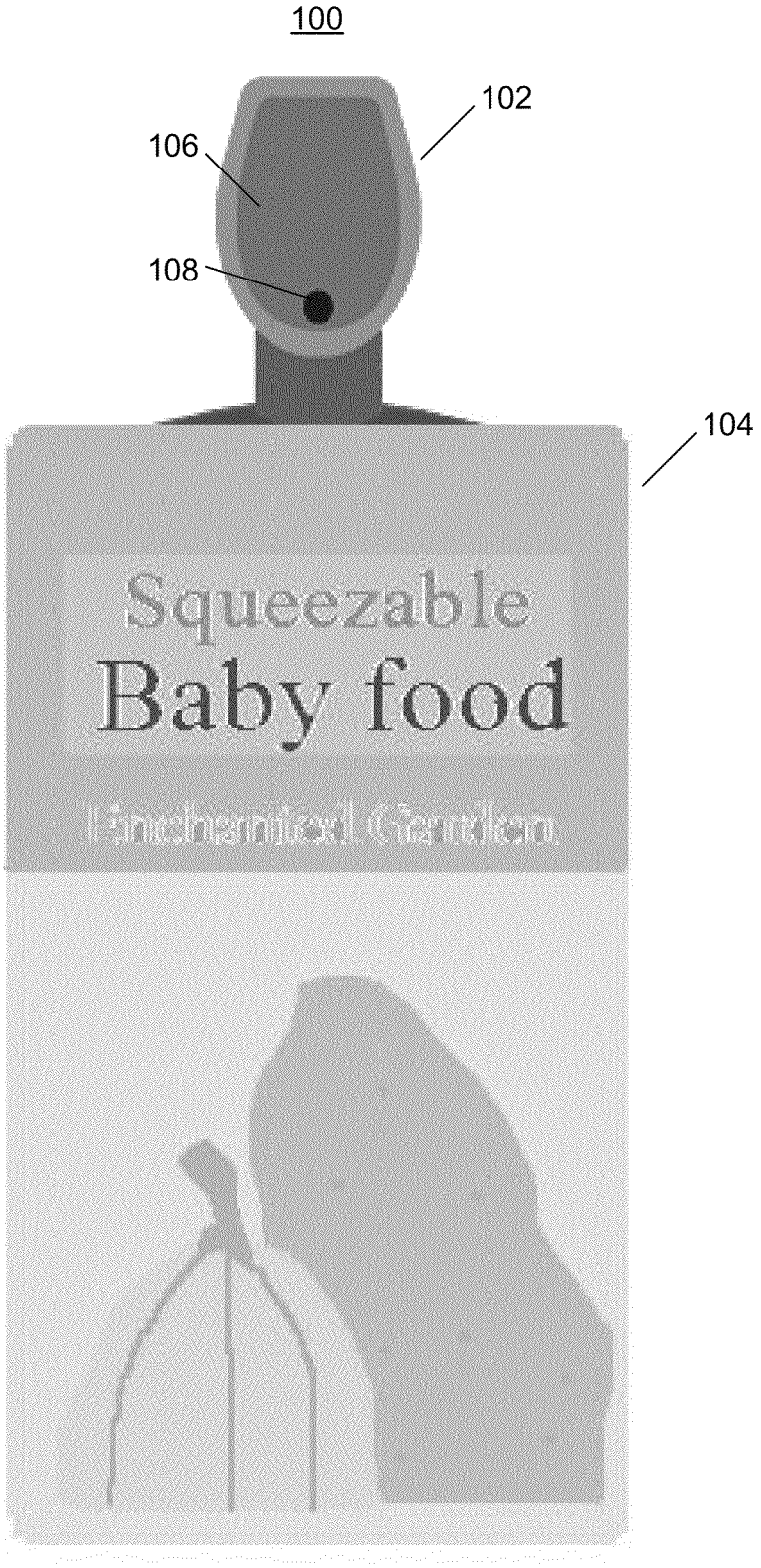
FIG. 1 is a diagram of an example embodiment of a system in accordance with the disclosed subject matter.

Referring to the Figures in which like numerals indicate like elements, FIG. 1 is a diagram of an example embodiment of a system 100 in accordance with the disclosed subject matter. In one embodiment, the system 100 may include a container 104, and a mouthpiece fitment or food dispensing mouthpiece 102.

In some embodiments, the container 104 may include a flexible pouch. In various embodiments, the container or flexible pouch 104 may include two or more pieces of metal foil or thin plastic sheets sandwiched together along the edges of the container 104. In one embodiment, the edges may be sealed so as to contain a fluid or semi-liquid edible material within the container 104. In this context, the term "semi-liquid" may include liquids and materials capable of flowing like a fluid that are neither fully solid nor fully liquid (e.g., ground or puréed vegetables or fruits, etc.). In various embodiments, the edible material may include, for example, infant food, medicine, sports related food, soft ice cream, etc.; although, it is understood that the above are merely a few illustrative examples to which the disclosed subject matter is not limited.

In various embodiments, the container 104 may be manufactured by gluing or welding together the edges of the two or more thin sheets on at least two sides. In one embodiment, a third or top side may be sealed by gluing or welding the two thin sheets to a portion of the food dispensing mouthpiece 102, such that a portion of the food dispensing mouthpiece 102 is substantially sandwiched in between the two thin sheets. In such an embodiment, the partially manufactured container 104 may be open, at least partially, on a fourth side and sealed on the remaining three sides. In various embodiments, the edible material may be poured or injected into the container 104 via the fourth open side. In some embodiments, this fourth side may then be sealed.

In various embodiments, the container 104 may be substantially flexible to facilitate squeezing the semi-liquid edible material out of an opening in the container 104. In such an embodiment, the opening may be provided by the food dispensing mouthpiece 102.

In one embodiment, the food dispensing mouthpiece 102 may be configured to facilitate the eating of the fluid or semi-liquid edible material stored within the container 104. In various embodiments, the food dispensing mouthpiece 102 may include a concave holding portion 106 and a tubular hole or channel 108. In some embodiments, the concave holding portion 106 may be configured to hold the portion of fluid or semi-liquid edible material discharged from the container 104. In one embodiment, the tubular hole or channel 108 may be configured to route or transmit the fluid or semi-liquid edible material from the container 104 to the concave holding portion 106. In various embodiments, a user or person may squeeze the flexible container 104, creating pressure that may force the edible material through the tubular hole or channel 108 and into the concave holding portion 106.

Figure 2:
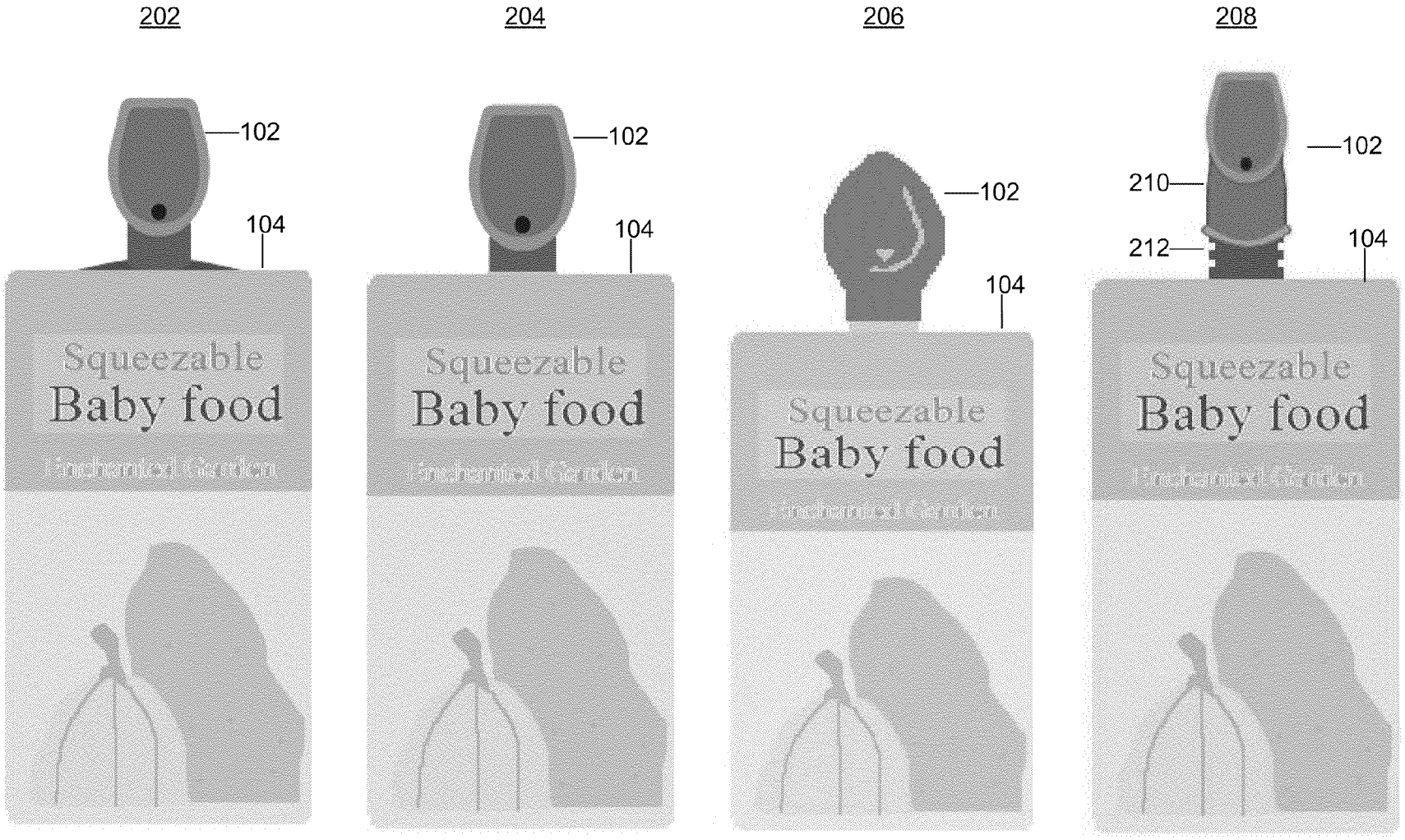
FIG. 2 is a series of diagrams of example embodiments of systems in accordance with the disclosed subject matter.

FIG. 2 is a series of diagrams of example embodiments of systems 202, 204, 206, and 208 in accordance with the disclosed subject matter. FIG. 2 illustrates several possible styles or embodiments of the disclosed subject matter; although, it is understood that the above are merely a few illustrative examples to which the disclosed subject matter is not limited.

System 202 illustrates an embodiment in which the food dispensing mouthpiece 102 is substantially shovel shaped and an attachment portion of the food dispensing mouthpiece 102 is partially exposed. In various embodiments, the food dispensing mouthpiece 102 may include a flat, substantially square end configured to facilitate scooping any dropped edible material back into the concave holding portion, as described above. System 204 illustrates an embodiment in which the food dispensing mouthpiece 102 is substantially shovel shaped and an attachable portion of the food dispensing mouthpiece 102 is substantially flush with the container 104.

System 206 illustrates that, in one embodiment, the food dispensing mouthpiece 102 is substantially spoon shaped. In such an embodiment, the end of the food dispensing mouthpiece 102 may be substantially rounded. In various embodiments, the substantially rounded end of the food dispensing mouthpiece 102 may be configured to facilitate entry into the mouth.

System 208 illustrates an embodiment in which the food dispensing mouthpiece 102 may include a movable mouthpiece 210 and a fixed fitment 212. In various embodiments, the movable mouthpiece 210 may be removable, as described below. In other embodiments, the moveable mouthpiece 210 may be moveable between an open position, in which the edible material may flow to the concave holding portion, and a closed position, in which the edible material is substantially prevented from being discharged from the container 104.

FIG. 3 includes a series of diagrams of an example embodiment of an apparatus 300 in accordance with the disclosed subject matter. FIG. 3*a* is an isometric diagram of an example embodiment of an apparatus 300 in accordance with the disclosed subject matter. FIG. 3*b* is a side-facing diagram of an example embodiment of the apparatus 300 in accordance with the disclosed subject matter. In one embodiment, the apparatus 300 may include a fitment 302, a neck portion 304, and a mouthpiece 306.

In various embodiments, the fitment 302 may be configured to attach the apparatus substantially permanently with a flexible pouch containing fluid or semi-liquid edible material. In one embodiment, the fitment 302 may be ribbed or corrugated to facilitate attaching the fitment 302 with the container. In some embodiments, the fitment 302 may be attached by gluing, welding, bonding, etc. the fitment 302 between two thin sheets of metal or plastic that comprise the container.

In one embodiment, the fitment 302 may include a substantially elongated oval shape, as illustrated by FIG. 3*a*. In such an embodiment, the elongated ends of the fitment 302 may be configured to provide a relatively large amount of surface area to attach the fitment 302 with the container. In other embodiments, the fitment 302 may include a substantially circular shape, as opposed to the elongated oval shape illustrated in FIG. 3. In such an embodiment, the lack of elongated ends may facilitate the flexibility of the container and/or reduce costs and materials, respective to the illustrated elongated embodiment. Although, it is understood that the above are merely a few illustrative examples to which the disclosed subject matter is not limited.

In one embodiment, the apparatus 300 may include a neck portion 304. In various embodiments, the neck portion 304 may be configured to connect the fitment and a mouthpiece portion 306. In one embodiment, the neck 304 may include a base end coupled with the fitment 302 and a mouthpiece end coupled with the mouthpiece 306. In various embodiments, the base end may include a substantially rectangular latitudinal cross-section. In such an embodiment, the neck 304 may transition to a substantially round latitudinal cross-section at the mouthpiece end. In various embodiments, the round latitudinal cross-section may be configured to be pleasing to the mouth. In some embodiments, the neck portion 304 may be included as part of the mouthpiece 306.

In one embodiment, the apparatus 300 may include a mouthpiece 306. In various embodiments, the mouthpiece 306 may be configured to facilitate eating of the edible material, as described above. In some embodiments, the mouthpiece 306 may include the neck portion 304. In various embodiments, the mouthpiece 306 may be moveable, as described below. In one embodiment, the mouthpiece 306 may be compressible or elongatable, as described below. In such an embodiment, the mouthpiece 306 may be configured to be compressed if the mouthpiece 306 is roughly inserted into a person's mouth or a substantially equivalent action is performed. In some embodiments, the mouthpiece 306 may be removable, as described below.

FIG. 3*c* is a cross-sectional isometric diagram of an example embodiment of an apparatus 300 in accordance with the disclosed subject matter. FIG. 3*d* is a cross-sectional side-facing diagram of an example embodiment of an apparatus 300 in accordance with the disclosed subject matter.

In one embodiment, the fitment 302 may include a hole or spout 314. In various embodiments, the hole or spout 314 may be configured to discharge or provide an exit point for the edible semi-liquid material from the container. In various embodiments, the fitment 302 may extend towards or into the neck portion 304. In such an embodiment, this extension may form a spout 314 and may, in one embodiment, provide an attachment point for the mouthpiece 306 and/or the neck portion 304. In various embodiments, the mouthpiece 306 may move about this spout 314, as described below.

In one embodiment, the neck 304 may include a channel 312. In various embodiments, the channel 312 may be configured to transmit the semi-liquid edible material from the hole or spout 314 to the mouthpiece 306. In various embodiments, the channel 312 may include a first diameter at the end coupled with the hole or spout 314, and a second relatively smaller diameter as the end coupled with the mouthpiece 306. In another embodiment, the channel 312 may include a substantially uniform diameter.

In one embodiment, the mouthpiece 306 may include a concave or holding portion 308 and a tubular hole or channel 310. In various embodiments, the concave or holding portion 308 may be configured to hold the semi-liquid edible material that has been discharged (via the hole or spout 314, the neck 304 channel 312, and the tubular hole or channel 310) from the container. In various embodiments, the tubular hole or channel 310 may be configured to transmit or route the semi-liquid edible material from the container to the concave or holding portion 308. In some embodiments, the tubular hole or channel 310 may be positioned longitudinally within the mouthpiece 306.

In another embodiment, the tubular hole or channel 310 may include an exit point within the concave or holding portion 308. In various embodiments, the exit point of the tubular hole or channel 310 may be positioned substantially at the bottom of the concave or holding portion 308. In yet another embodiment, the exit point of the tubular hole or channel 310 may be positioned substantially part way up the side of the concave or holding portion 308 nearest the neck 304 or fitment 302. Although, it is understood that the above are merely a few illustrative examples to which the disclosed subject matter is not limited.

In various embodiments, the exit point of the tubular hole or channel 310 may include a flap or restraint 316 configured to reduce the unintentional discharge of the semi-liquid edible material from the tubular hole or channel 310. In various embodiments, such a flap or restraint may substantially reduce spilling of the edible material. In some embodiments, the flap or restraint may be configured to allow the edible material or a substantial amount of the edible material into the concave or holding portion 308 only when a threshold amount of force is applied; although, it is understood that the above is merely one illustrative example to which the disclosed subject matter is not limited.

In various embodiments, the apparatus 300 may not include a neck 304 or, in another embodiment, may include a neck without a channel 312. In such an embodiment, the hole or spout 314 of the fitment 302 may be coupled directly with the tubular hole or channel 310 of the mouthpiece 306.

Figure 4:
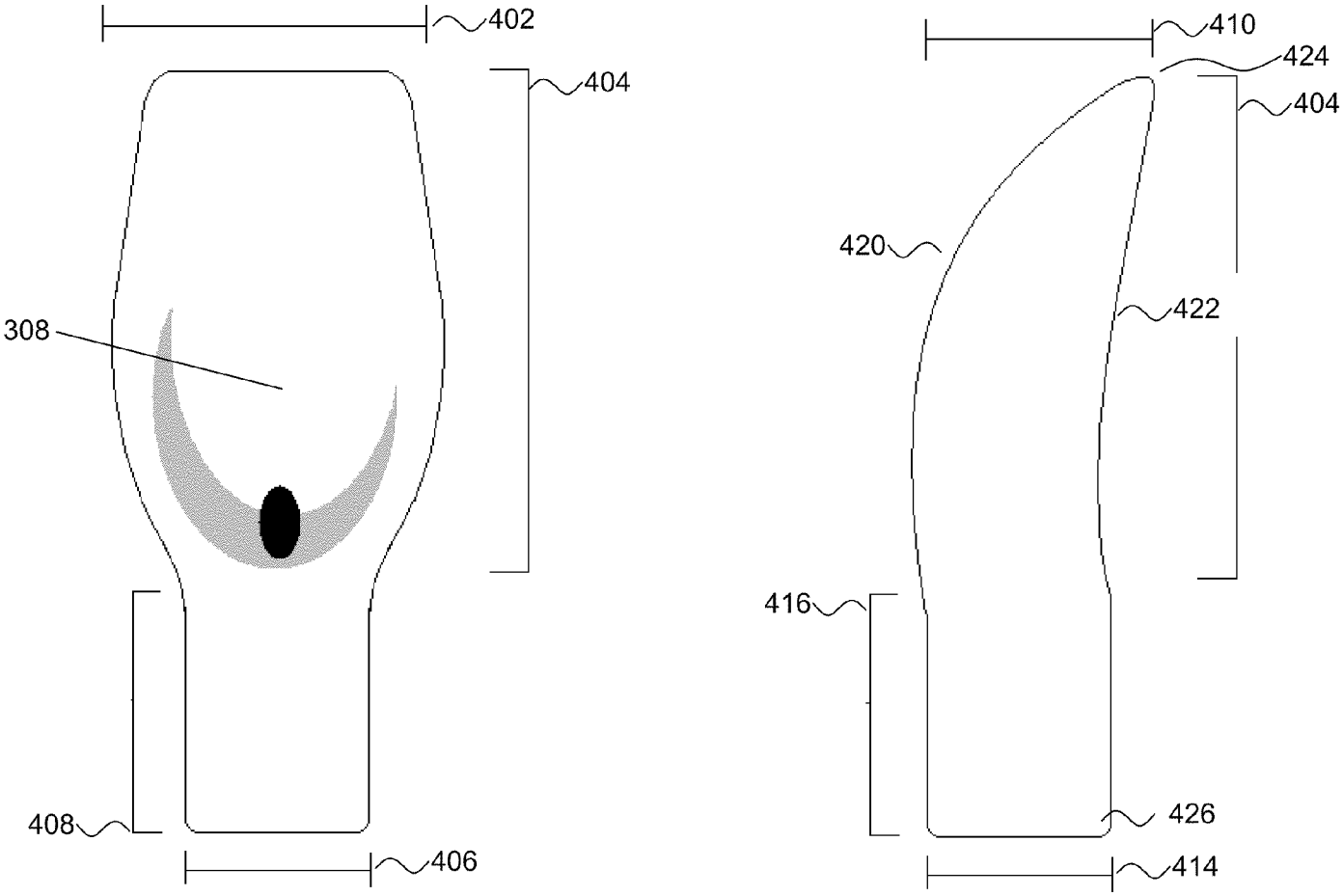
FIG. 4 includes front and side facing diagrams of an example embodiment of an apparatus in accordance with the disclosed subject matter.

FIG. 4 includes front and side facing diagrams of an example embodiment of an apparatus 400 in accordance with the disclosed subject matter. In one embodiment, the apparatus 400 may include a neck and/or mouthpiece portion (as illustrated) and a fitment portion (not shown).

In various embodiments, the neck may include a width dimension 406. In one illustrative embodiment, the neck's width dimension 406 may be, for example, one half of an inch (i.e., ½"). In various embodiments, the neck may include a height dimension 414. In one illustrative embodiment, the neck's height dimension 414 may be, for example, one half of an inch (i.e., ½"). In one embodiment, the neck may include a base or base end 426. In various embodiments, the neck may include a facing length dimension 408, from the base 426 of the neck to the portion coupled with the mouthpiece and oriented such that the concave or holding portion 308 is facing a viewer. In one illustrative embodiment, the neck's facing length dimension 408 may be, for example, one half of an inch (i.e., ½"). In various embodiments, the neck may include a back length dimension 416, from the base 426 of the neck to the portion coupled with the mouthpiece and oriented such that the concave or holding portion 308 is facing away from a viewer. In one illustrative embodiment, the neck's back length dimension 416 may be, for example, one half of an inch (i.e., ½"). Although, it is understood that the above are merely a few illustrative examples to which the disclosed subject matter is not limited.

FIG. 4 illustrates a substantially shovel shaped embodiment of the mouthpiece, as described above. In various embodiments, the mouthpiece may include a width dimension 402. In one illustrative embodiment, the mouthpiece's width dimension 402 may be, for example, three quarters of an inch (i.e., ¾"). In various embodiments, the mouthpiece may include a length dimension 404. In one illustrative embodiment, the mouthpiece's length dimension 404 may be, for example, one inch (i.e., 1"). In various embodiments, the mouthpiece may include a depth or height dimension 410. In one illustrative embodiment, the mouthpiece's depth or height dimension 410 may be, for example, one third of an inch (i.e., ⅓"). Although, it is understood that the above are merely a few illustrative examples to which the disclosed subject matter is not limited.

In one embodiment, the mouthpiece may include a back portion 420, a front portion 422, and a tip or mouth end 424. In various embodiments, the back portion 420 and the front portion 422 may be configured to form the concave or holding portion 308. In some embodiments, the back portion 420 may be or include a concave shape of a first depth or radius. The front portion 422 or at least the outer edges thereof may be or include a concave shape of a second depth or radius that is less than the depth of or greater than the radius of the back portion 420. In such an embodiment, the back portion 420 and front portion 422 may meet at a tip or mouth end 424, and end at the neck. In such an embodiment, the mouthpiece may form a substantially spoon or shovel shape. In one embodiment, the tip or mouth end 424 may include substantially squared corners and result in the mouthpiece including a substantially shovel shape (as illustrated). In another embodiment, the tip or mouth end 424 may be substantially rounded and result in the mouthpiece including a substantially spoon shape. In various embodiments, the mouthpiece and more specifically, in one embodiment, the tip or mouth end 424 may include substantially smooth or rounded edges.

Figure 5:
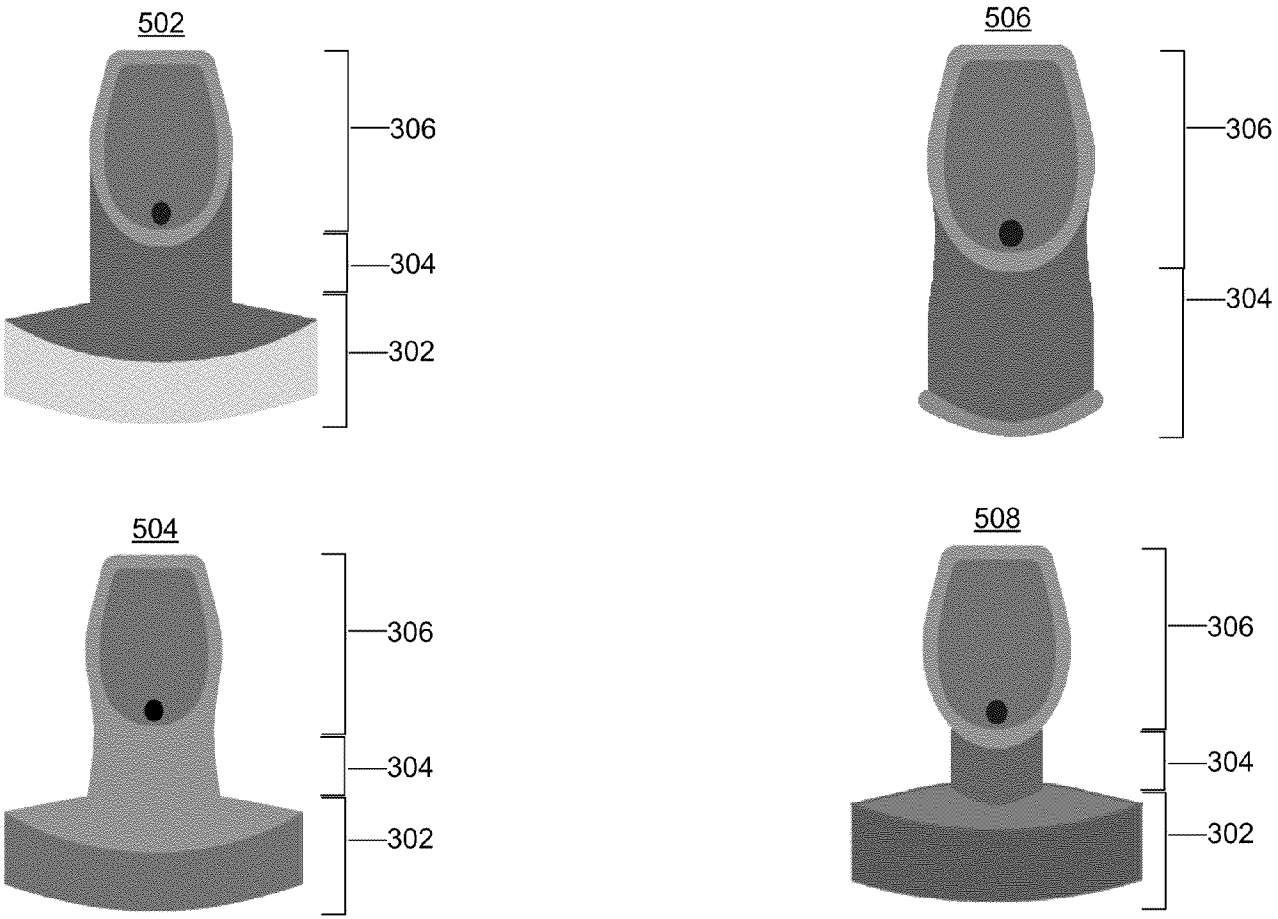
FIG. 5 is a series of front-facing diagrams of example embodiments of apparatuses in accordance with the disclosed subject matter.

FIG. 5 is a series of front-facing diagrams of example embodiments of apparatuses in accordance with the disclosed subject matter. In one embodiment, the apparatus 502 may include a fitment portion 302, a neck portion 304, and a mouthpiece portion 306. In such an embodiment, the neck portion 304 may be substantially flush with the widest part of the mouthpiece 306. In one embodiment, the apparatus 502 may include a single molded piece. In other embodiments, the apparatus 502 may include a number of pieces or parts, some of which may be moveable, as described above and below.

In one embodiment, the apparatus 504 may include a fitment portion 302, a neck portion 304, and a mouthpiece portion 306. In such an embodiment, the neck portion 304 may be curved and configured to gently blend into the mouthpiece 306. In such an embodiment, the apparatus 504 may include a shape more pleasing to the mouth with few or no abrupt edges. Once again, in various embodiments, the apparatus 504 may include a single molded or manufactured piece, while in other embodiments, the apparatus 504 may include multiple pieces.

In one embodiment, the apparatus 506 may include a mouthpiece 306 and a neck portion 304. In some embodiments, the mouthpiece 306 may include the neck portion 304. In various embodiments, the apparatus 506 may be removable from the fitment (not shown), as described below in reference to FIG. 8. In some embodiments, the apparatus 506 may include a series of threads (e.g., internal threads) such that the apparatus 506 is configured to be screwed off of or on to the fitment. In another embodiment, the apparatus 506 may be secured via a vertical motion and held in place by compression. For example, the fitment may include a ring or bump that is configured to rest inside a receiving groove internally within the apparatus 506. In such an embodiment, the apparatus 506 may be held in place by the compression of the neck 304 on the ring or bump. Although, it is understood that the above are merely a few illustrative examples to which the disclosed subject matter is not limited.

In one embodiment, the apparatus 508 may include a fitment portion 302, a neck portion 304, and a mouthpiece portion 306. In such an embodiment, the neck portion 304 may include a diameter that is less than the diameter of the mouthpiece 306. In such an embodiment, the apparatus 508 may include a single piece, as described above. In another embodiment, the apparatus 508 may include a plurality of pieces. In various embodiments, these pieces may be welded or fixedly coupled together. In another embodiment, these pieces may be movably or removably coupled together, as described below. In yet another embodiment, a combination of both fixedly coupling, movably coupling, and removably coupling may be used.

In various embodiments, the mouthpiece 306 and/or neck 304 may include a relatively soft or flexible material, as compared to the fitment 302. In such an embodiment, the mouthpiece 306 and/or neck 304 may be configured to reduce the chance of injury to the individual eating the edible material. In some embodiments, the mouthpiece 306 and/or neck 304 may be merely covered with the relatively soft or flexible material and harder core material may be used to provide the general shape of the apparatuses.

It is understood that the above are merely a few illustrative examples to which the disclosed subject matter is not limited. These four example embodiments of FIG. 5 merely show a variety of design considerations that may be included in some embodiments of the disclosed subject matter.

Figure 6A:
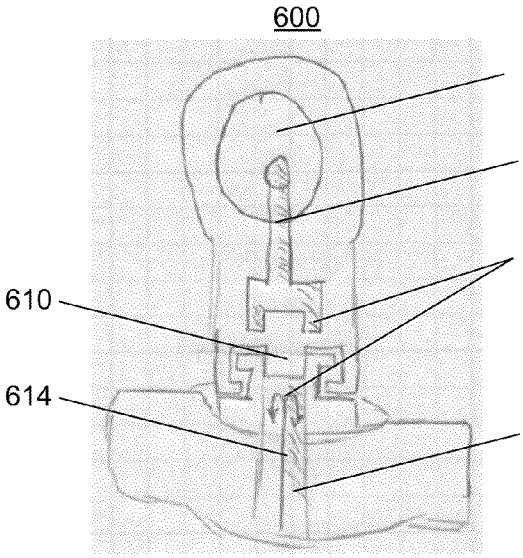
FIG. 6 is a series of cut-away diagrams of an example embodiment of an apparatus in accordance with the disclosed subject matter in both an open and closed position.
Figure 6B:
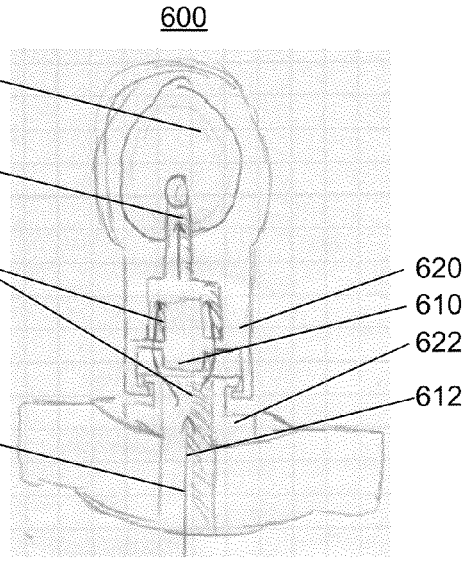

FIG. 6 is a series of cut-away diagrams of an example embodiment of an apparatus 600 in accordance with the disclosed subject matter in both an open and closed position. FIG. 6*a* illustrates an apparatus 600 in an open position. While, FIG. 6*b* illustrates the apparatus 600 in a closed position.

In various embodiments, the apparatus 600 may include a moveable portion 620 and a non-movable portion 622. In one embodiment, the non-movable portion 622 may be configured to be coupled with or included as part of the fitment. In one embodiment, the moveable portion 620 may be configured to move between a closed or first position (illustrated by FIG. 6*a*) and an open or second position (illustrated by FIG. 6*b*). In various embodiments, the moveable portion 620 may be included as part of the neck and/or mouthpiece.

In one embodiment, apparatus 600 may include a concave or holding portion 602, a mouthpiece channel or tubular hole 604, a neck portion channel 606, and a fitment hole or spout 608. In some embodiments, the neck portion channel 606 may be included or considered to be part of the tubular hole 604. In various embodiments, the edible material may exit the container via the fitment hole or spout 608.

As illustrated by FIG. 6*a*, the apparatus 600 may include a plug 610. In such an embodiment, the plug 610 may be configured to substantially block or close the neck portion channel 606. In one embodiment, the plug 610 may be configured to, when in the closed or first position, prevent substantially any edible material from being transmitted between the fitment hole or spout 608 and the concave or holding portion 602. The flow of the edible material, in one embodiment, is illustrated by arrow 614. In such an embodiment, the edible material may flow through the fitment hole or spout 608 and, in one embodiment, partially through the neck channel portion 606 and be stopped by the plug 610.

As illustrated by FIG. 6*b*, in one embodiment, the plug 610 may be configured to, when in the open or second position, allow or not prevent edible material from being transmitted between the fitment hole or spout 608 and the concave or holding portion 602. The flow of the edible material, in one embodiment, is illustrated by arrow 612. In such an embodiment, the edible material may flow through the fitment hole or spout 608, the neck channel 606, and the mouthpiece channel or tubular hole 604 and into the concave or holding portion 602.

It is understood that the plug 610 is merely one illustrative example of a technique to prevent the flow of the edible material to which the disclosed subject matter is not limited, and that other techniques are within the scope of the disclosed subject matter. For example, a horizontally sliding member may be used; although, it is understood that this again is merely one illustrative example to which the disclosed subject matter is not limited.

Figure 7A:
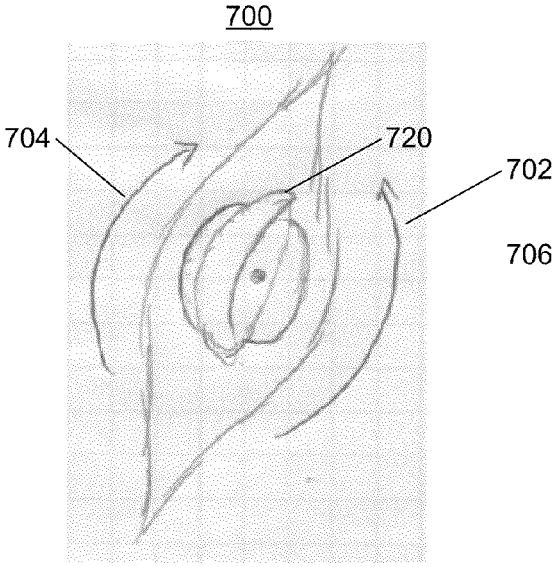
FIG. 7*a* is a top-down diagram of an example embodiment of an apparatus in accordance with the disclosed subject matter.

FIG. 7*a* is a top-down diagram of an example embodiment of an apparatus 700 in accordance with the disclosed subject matter. In one embodiment, the apparatus 700 may include a twist-open mouthpiece 720. In such an embodiment, the twist-open mouthpiece 720 may be configured to be placed into the open position, as described above, by rotating the mouthpiece a first direction 702. In one embodiment, the twist-open mouthpiece 720 may configured to be placed into the closed position, as described above, by rotating the mouthpiece in a second direction 704 that is opposite the first direction 702. In various embodiments, the mouthpiece 720 may ride along a screw-like thread that may be configured to raise or lower the mouthpiece 720 depending upon the direction of rotation. It is also understood that the orientation of the first direction 702 and second direction 704 are merely illustrative and not limiting on the disclosed subject matter.

Figure 7B:
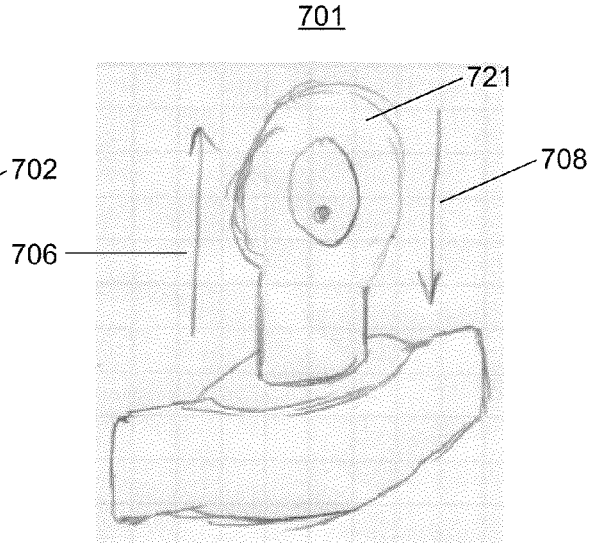
FIG. 7*b* is an isometric diagram of an example embodiment of an apparatus in accordance with the disclosed subject matter.

FIG. 7*b* is an isometric diagram of an example embodiment of an apparatus 701 in accordance with the disclosed subject matter. In one embodiment, the apparatus 701 may include a pop-open mouthpiece 721. In such an embodiment, the pop-open mouthpiece 721 may be configured to be placed into the open position, as described above, by extending or elongating the mouthpiece longitudinally in a first direction 706. In one embodiment, the pop-open mouthpiece 721 may configured to be placed into the closed position, as described above, by compressing the mouthpiece longitudinally in a second direction 708 that is opposite the first direction 706. In various embodiments, the mouthpiece 721 may include sufficient frictional force to prevent the mouthpiece 721 from compressing or extending without the application of substantial external force. As described above, in one embodiment, the mouthpiece 721 may include a groove in which a ring of the fitment or neck may rest to prevent the unintentional movement of the mouthpiece 721, as described above. Although, it is understood that the above are merely a few illustrative examples to which the disclosed subject matter is not limited. It is also understood that the orientation of the first direction 706 and second direction 708 are merely illustrative and not limiting on the disclosed subject matter.

FIG. 8 is a series of diagrams of an example embodiment of a system 800 illustrating a screw-off mouthpiece in accordance with the disclosed subject matter. In one embodiment, the system 800 may include the container 104, the fitment 302, and the mouthpiece 306.

In various embodiments, the container 104 may be substantially permanently coupled with fitment 302. However, in one embodiment, the mouthpiece 306 may be removable. In one such embodiment, the mouthpiece 306 may include a screw-off mouthpiece. In one embodiment, the fitment 302 may include a thread 802 configured to raise or lower the mouthpiece 306 as the mouthpiece 306 is rotated on or off, respectively. In various embodiments, the thread 802 may be configured to removably couple the mouthpiece 302 with the fitment 302. In one embodiment, the mouthpiece 306 may include a female or receiving portion having a notch or receiving thread internal to the mouthpiece and configured to ride along the thread 802. In various embodiments, a neck portion may include either the threaded portion of the fitment 302, or the receiving portion of the mouthpiece 306.

In another embodiment, a system may include a pull-off mouthpiece, as described above in reference to FIGS. 2 and 5. In such an embodiment, the mouthpiece may be configured to be removed by pulling the mouthpiece away from the fitment along the longitudinal or vertical axis of the system. Likewise, in such an embodiment, the mouthpiece may be configured to be coupled with the fitment by pushing or shoving the mouthpiece towards the fitment along the longitudinal or vertical axis of the system. Although, it is understood that the above are merely a few illustrative examples to which the disclosed subject matter is not limited.

In one embodiment, the system 800 may include a removable tamper-seal 804. In various embodiments, the removable tamper-seal 804 may be configured to, when coupled with the system, block the channel of a neck portion or spout of the fitment 302, such that substantially no edible material may flow to the mouthpiece 306. In such an embodiment, the removable tamper-seal 804 may be configured to only be removable once the mouthpiece 306 has been uncoupled from the fitment 302. For example, in one embodiment, the mouthpiece 306 may be coupled, during manufacture and at the time of sale, with the fitment 302 such that the tamper-seal 804 is not accessible or removable. In such an embodiment, a user may need to remove the mouthpiece 306 in order to remove the tamper-seal 804 and, therefore, render the system 800 useable, in that the edible material may be discharged. Such a user may wish to re-couple the mouthpiece 306 with the fitment 302 in order for the edible material to be discharged into the mouthpiece 306.

In one embodiment, the tamper-seal 804 may include a tab or indicator 806 that may be visible, if the tamper-seal 804 has not been removed, without removing the mouthpiece 306. In such an embodiment, a user may look for the tab or indicator 806 to determine if the tamper-seal 804 is in place before purchasing the system 800. In some embodiments, the tamper-seal 804 may be configured to provide a user with an assurance that the edible material has not been tampered with or altered since the system 800 was manufactured.

Figure 9:
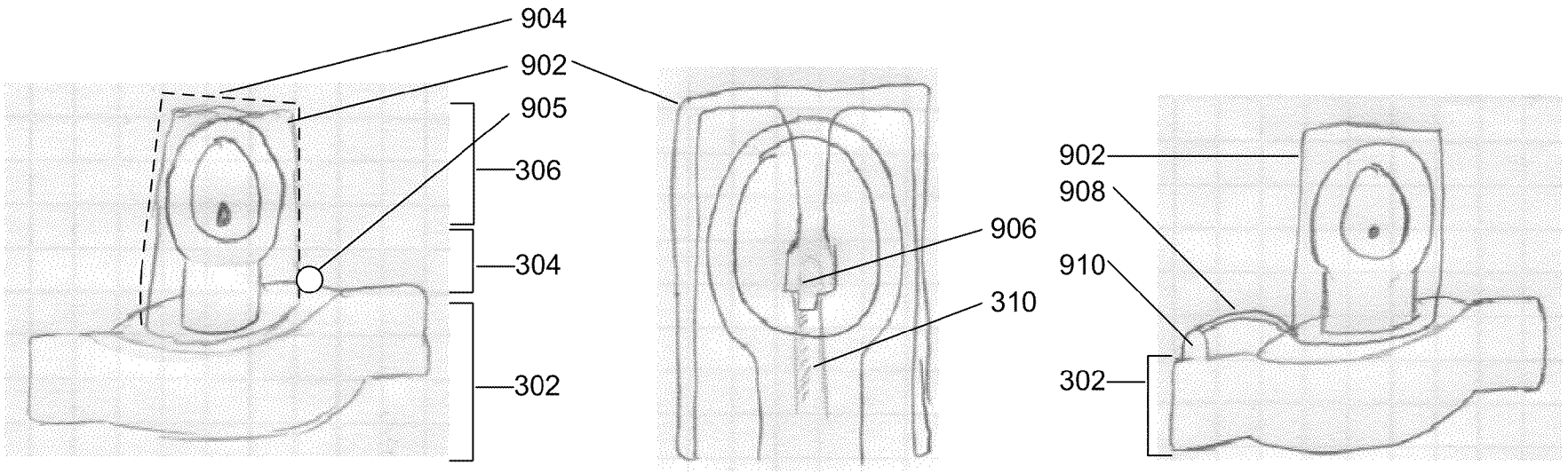
FIG. 9 is a series of diagrams of an example embodiment of an apparatus illustrating a cap and safety-sealing plug in accordance with the disclosed subject matter.

FIG. 9 is a series of diagrams of an example embodiment of an apparatus 900 illustrating a cap 902 and safety-sealing plug 906 in accordance with the disclosed subject matter. In one embodiment, the apparatus 900 may include a fitment 302, a neck portion 304, a mouthpiece 306, and a removable cap 902. In one embodiment, the mouthpiece 306 may include a channel or tubular hole 310 configured to transmit or route edible material from the container to the concave or holding portion of the mouthpiece 302, as described above.

In one embodiment, the removable cap 902 may be configured to cover or fit over and protect the mouthpiece 306 and/or neck portion 304 of the apparatus 900. In various embodiments, the removable cap 902 may be substantially transparent or semi-transparent and configured to allow a person to view the mouthpiece within.

In one embodiment, the apparatus 900 may also include a plastic wrap 904. In various embodiments, the plastic wrap 904 may be configured to cover or substantially seal the cap 902, and in turn the mouthpiece 306 and/or neck portion 304. In another embodiment, in which the apparatus 900 does not include a cap 902, the plastic wrap 904 may be configured to directly cover or substantially seal the mouthpiece 306 and/or neck portion 304. In some embodiments, the plastic wrap 904 may be configured to indicate tampering or prior use of the apparatus 900. In one embodiment, the plastic wrap 904 may include a pull-tab 905 configured to facilitate the unwrapping and removal of the plastic wrap 904 from the apparatus 900. In various embodiments, the wrap 904 may include substances or materials other than plastic (e.g., biodegradable material, etc.) and it is understood that the disclosed subject matter is not limited to the plastic illustrative example.

In one embodiment, the removable cap 902 may include a plug 906 or other tamper-seal mechanism configured to block the channel or tubular hole 310, such that substantially no edible material may be discharged into the mouthpiece 302. In various embodiments, the plug 906 may be semi-permanently sealed with the mouthpiece 306. In such an embodiment, the plug 306 may be configured to generally indicate tampering with the apparatus 900 and more specifically, in one embodiment, whether or not the cap 902 has been removed since manufacture.

In one embodiment, the plug 906 may be semi-permanently coupled with the mouthpiece 306 via a seal or other breakable coupling mechanism. In various embodiments, the plug 606 may be configured such that the removal of the cap 902 may break the seal coupling the plug 606 with the mouthpiece 306. In some embodiments, the plug may be coupled with the cap 902 such that removal of the cap 902 may remove the plug 606 from the channel or tubular hole 310 and allow the discharge or flow of the semi-liquid edible material from the container to the mouthpiece 306. In such an embodiment, the cap 602 may be substantially transparent or semi-transparent to facilitate the determination by a person or otherwise of whether or not the seal is broken.

In one embodiment, the apparatus 900 or the removable cap 902 may include a leash 908. In such an embodiment, the removable cap 902 may be coupled, via the leash 908, with the neck portion 304 or the fitment 302. In one embodiment, the leach may be coupled with the fitment 302 at an anchor point 310. In various embodiments, the leash 908 may be configured to keep the removable cap 902 attached with the apparatus 900 after or when the removable cap 902 has been removed from the mouthpiece 306. In some embodiments, this may prevent or substantially reduce the chance of the removable cap 902 becoming a choking hazard, especially for small children or infants for example.

Figure 10:
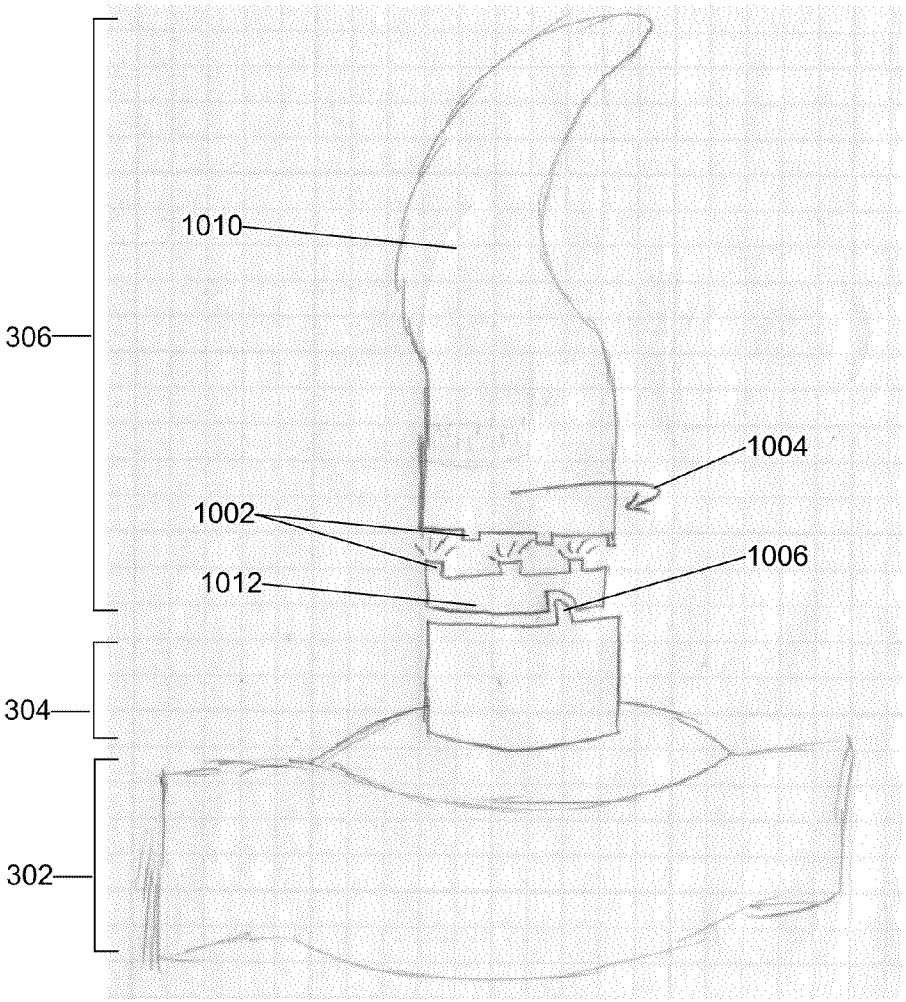
FIG. 10 is a side-facing diagram of an example embodiment of an apparatus in accordance with the disclosed subject matter.

FIG. 10 is a side-facing diagram of an example embodiment of an apparatus 1000 in accordance with the disclosed subject matter. In one embodiment, the apparatus 1000 may include a fitment 302, a neck portion 304, and a mouthpiece 306. In one embodiment, the mouthpiece 306 may include a safety indicator or tamper-proofing portion 1002 (shown in a broken state). In various embodiments, the tamper-proofing portion 1002 may include a plurality of tabs or posts, as illustrated by FIG. 10; although, it is understood that the above is merely one illustrative example to which the disclosed subject matter is not limited.

In one embodiment, tamper-proofing portion 1002 may be configured to indicate whether or not the mouthpiece 302 has been placed in an open position, as described above (e.g., apparatus 600 in FIG. 6*b*), since the apparatus 1000 has been manufactured. In various embodiments, the tamper-proofing portion 1002 may be configured to be broken when the mouthpiece is first (after manufacture) placed in the open position.

In one illustrative embodiment, the tamper-proofing portion 1002 may include a plurality of breakable posts coupling a movable portion 1010 of the mouthpiece 306 with a non-movable portion 1012. In various embodiments, the non-movable portion 1012 may be included as part of the mouthpiece 306 or, in one embodiment, the neck portion 304. In one embodiment, when the mouthpiece 306 is first moved to the open position, via illustrated direction of movement 1004, the plurality of tabs in the tamper-proofing portion 1002 may attempt to move with the moveable portion 1010 of the mouthpiece 306. However, in one embodiment, the bottom half of the tabs may be prevented from moving due to being coupled with the non-movable portion 1012. In various embodiments, the non-moveable portion 1012 may be incapable of substantial movement due to blocking tab 1006. In such an embodiment, as more force is applied to the mouthpiece 306 along direction 1004, the plurality of posts of the tamper-proofing portion 1002 may be configured to break and allow the movable portion 1010 to freely rotate. In various embodiments, the tamper-proofing portion 1002 may be configured to be substantially non-repairable. In such an embodiment, the tamper-proofing portion 1002 may provide an indication of whether or not the mouthpiece 306 was ever opened (after manufacture). It is understood that the above is merely one illustrative example to which the disclosed subject matter is not limited.

In another embodiment, a predetermined amount or dose of material in the container 104 can be provided for consumption. The administration of a predetermined dose of material can be accomplished by using a container (e.g., a pouch) having a specific predetermined size that is designed to hold a predetermined amount, or dose, of material. Various containers 104 having a variety of different sizes to accommodate different predetermined amounts of food/puree/liquid/medicine can be used with the system 100. The container would be designed and specified for a one-time use application, so that the user would receive the predetermined amount of material contained in the container 104 during the single use. For example, if a person who had gastric bypass surgery were to gradually resume eating, a container holding a predetermined amount of material (e.g., one, two, or three ounces of pureed food) could be used with the system 100, so that the person could consume a specific known quantity of food without having to "measure" on their own food. The predetermined amount of material could range from micrograms (e.g., an amount of medicine mixed with a predetermined amount of fluid or solid material in the container) up to several ounces, or even pounds of material.

Figure 24:
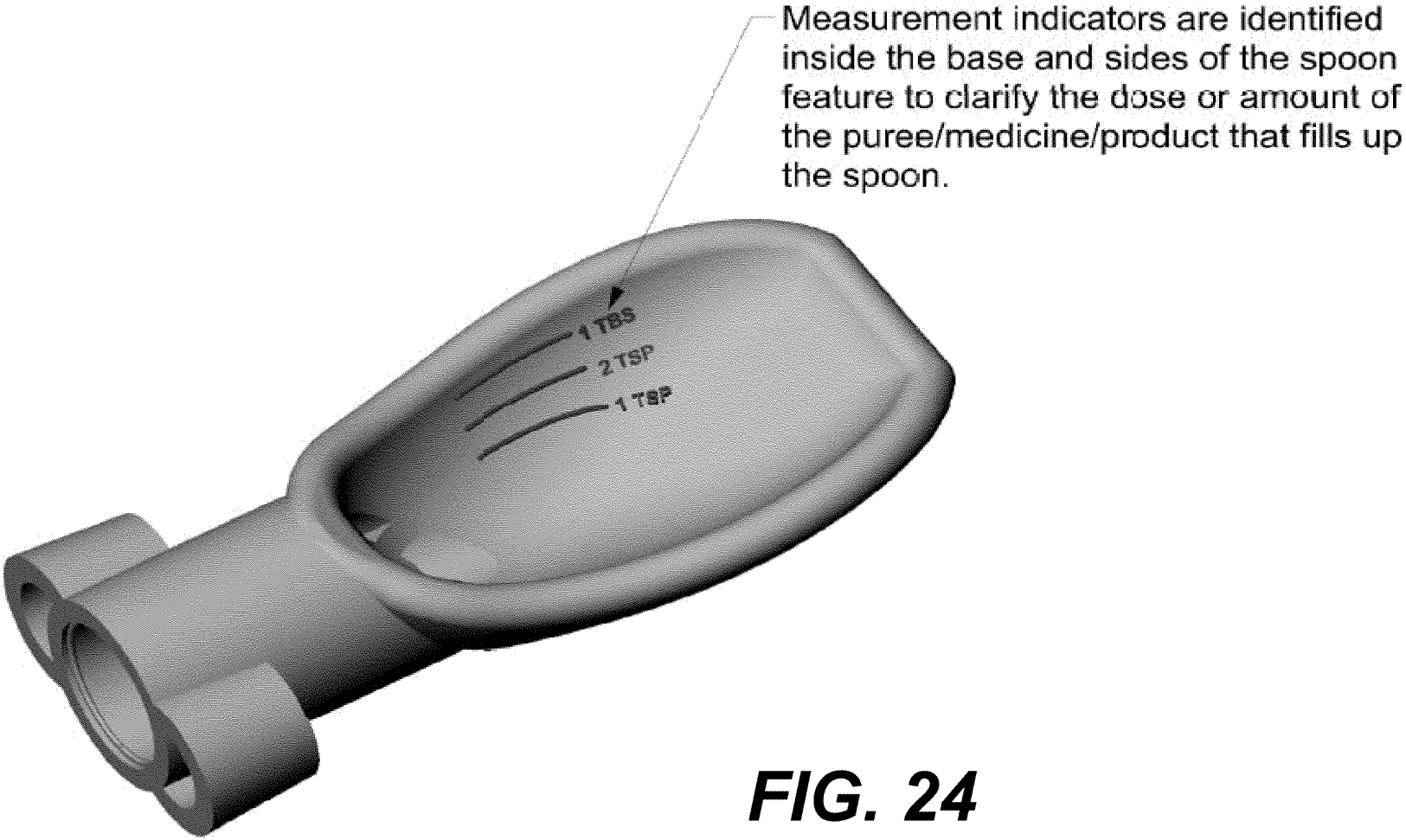

A measured dose also can be provided by administering a measured quantity of material from the container 104 to the spoon of the mouthpiece. For example, as shown in FIG. 24, the spoon may include indicia showing a measured quantity of liquid, semi-liquid, or solid material in the spoon. Thus, a user may squeeze the container to administer a known quantity of material into the spoon, as determined by one of the indicia in the spoon.

Figure 11:
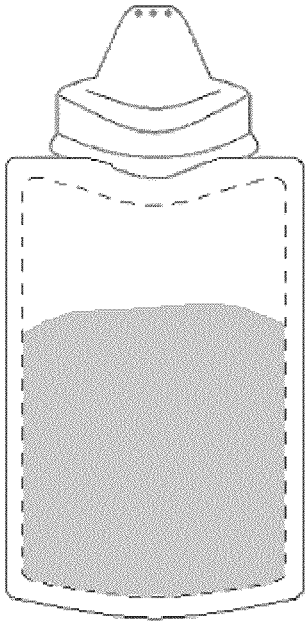
FIGS. 11-24 show additional features of the system.
Figure 12:
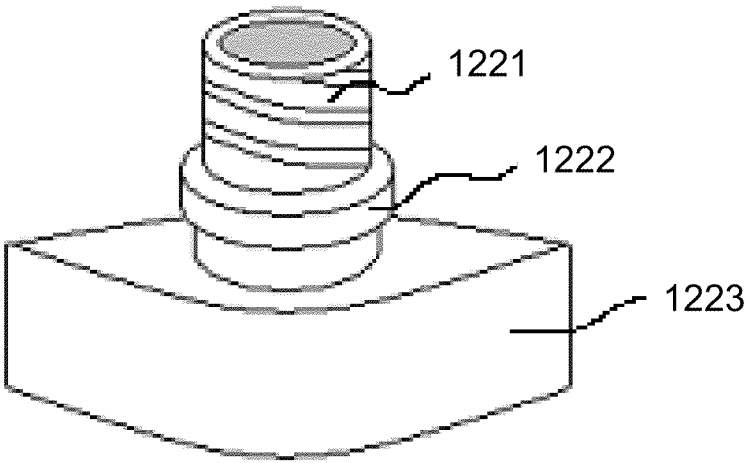
Figure 13:
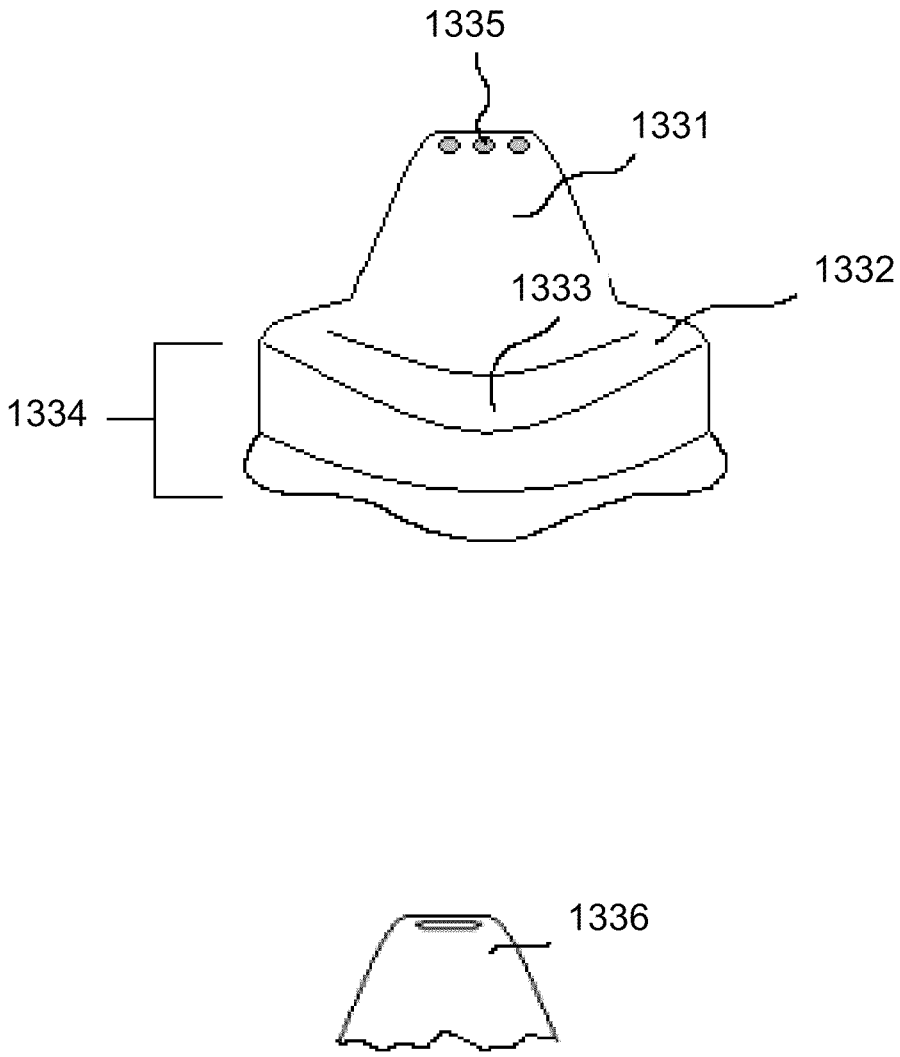

In another embodiment the mouthpiece of the feeding apparatus can be sealed to a pouch or screwed onto a container to form a single feeding device, as shown in FIG. 11. As shown in FIGS. 12 and 13, the system 100 can include spout or neck portion (shown in FIG. 12) and a mouthpiece portion (shown in FIG. 13). In FIG. 12, the spout can cylindrical with a threaded portion 1221 at its uppermost portion. There may also be additional projections 1222 and 1223 from the middle to lower portion of the cylinder to facilitate handling and sealing by the filling and processing machinery. As shown in FIG. 13, the mouthpiece portion can incorporate a trapezoid shaped cone 1331, a mouthguard 1332 with special contours 1333, and a skirt 1334. The portion of the mouthpiece that is inserted into the mouth of the consumer can be the trapezoid shaped cone 1331. The trapezoid shaped cone element of the mouthpiece can include, at the top and narrow end, circular openings 1335. There may be multiple openings as shown in FIG. 13 or a single oval opening 1336 that is adequately sized to allow sufficient flow of food through the opening.

Figure 14:
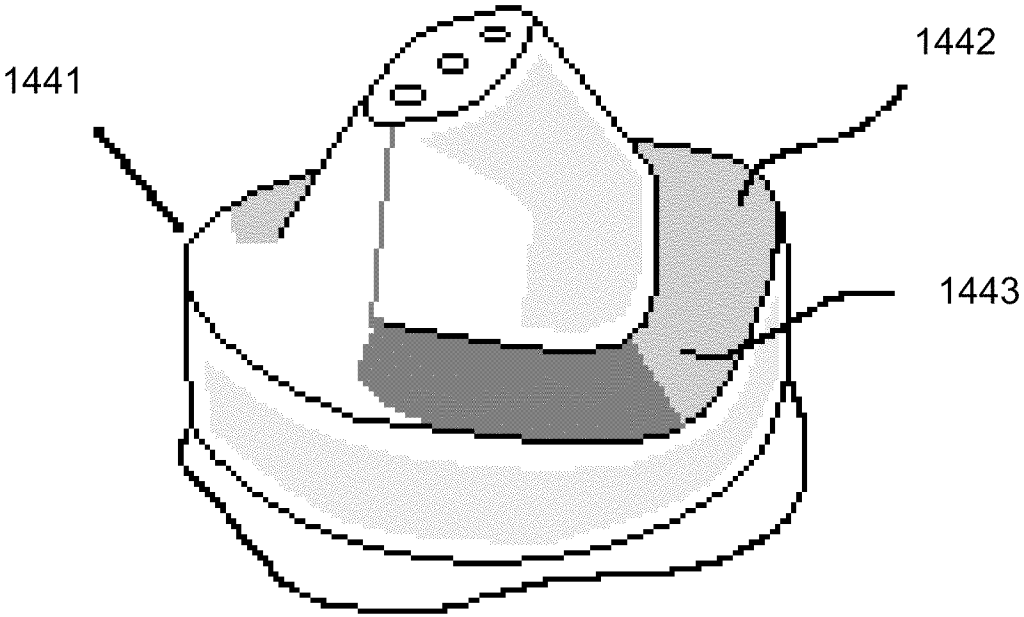

FIG. 14 shows a slightly angular top view of the mouthpiece. Extending from the trapezoid shaped cone, the base can expands out to create the mouthguard 1441, which includes comfortable contours 1442 and 1443 to allow the trapezoid shaped cone to be inserted into the mouth and the lips of the consumer to rest comfortably against the contours of the mouthguard. Additionally, the expanded base and contours can act as a guard to prevent the trapezoid shaped cone of the mouthpiece from being inserted too deeply into the mouth.

Figure 15:
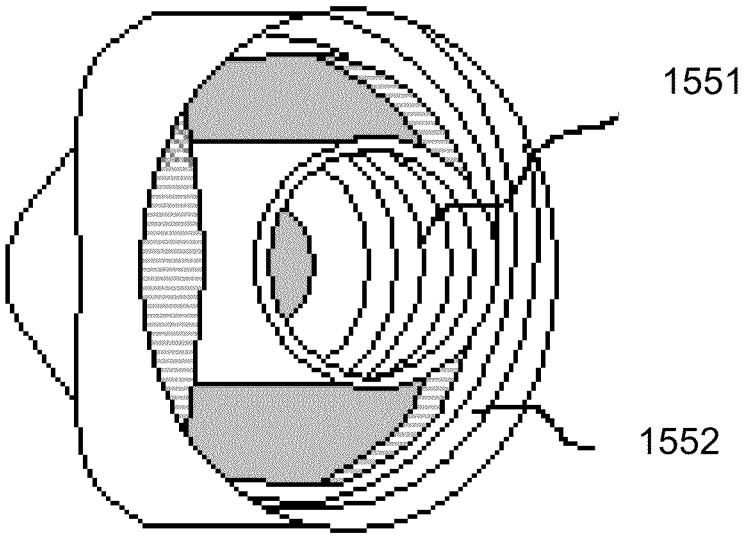
Figure 15:
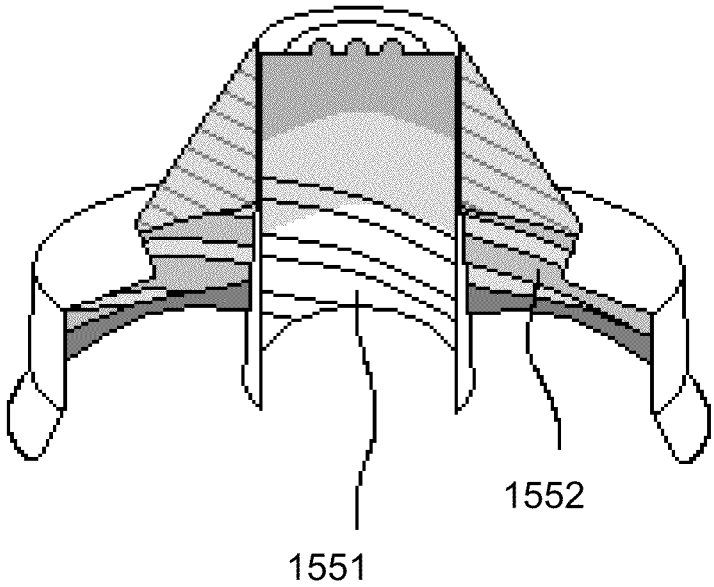
Figure 16:
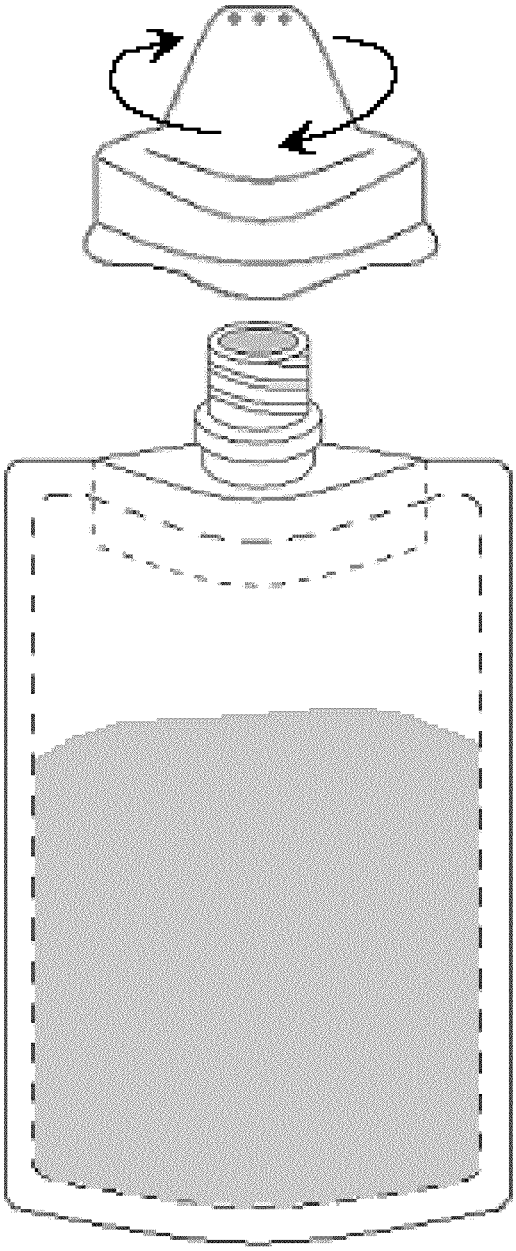

As shown in FIG. 15, beyond the mouthguard, the base continues and hangs beyond the contours to create a skirt 1444, which allows the lower portion of the spout to be hidden from view when the spout and mouthpiece are securely twisted and fully engaged. On the inside of the mouthpiece, threading grooves 1551 and 1552 can be incorporated at the narrow portion where the spout engages the mouthpiece and on the underside of the skirt, respectively, so as to allow the feeding apparatus to be attached to the spout or food containers that have similar size openings and screw cap actions. As shown in FIG. 16, the feeding apparatus can be created when the mouthpiece is securely screwed onto the spout. The feeding apparatus then can be attached to a pouch using airtight and watertight seams or screwed onto a container with similar size opening and screwing action.

Figure 17:
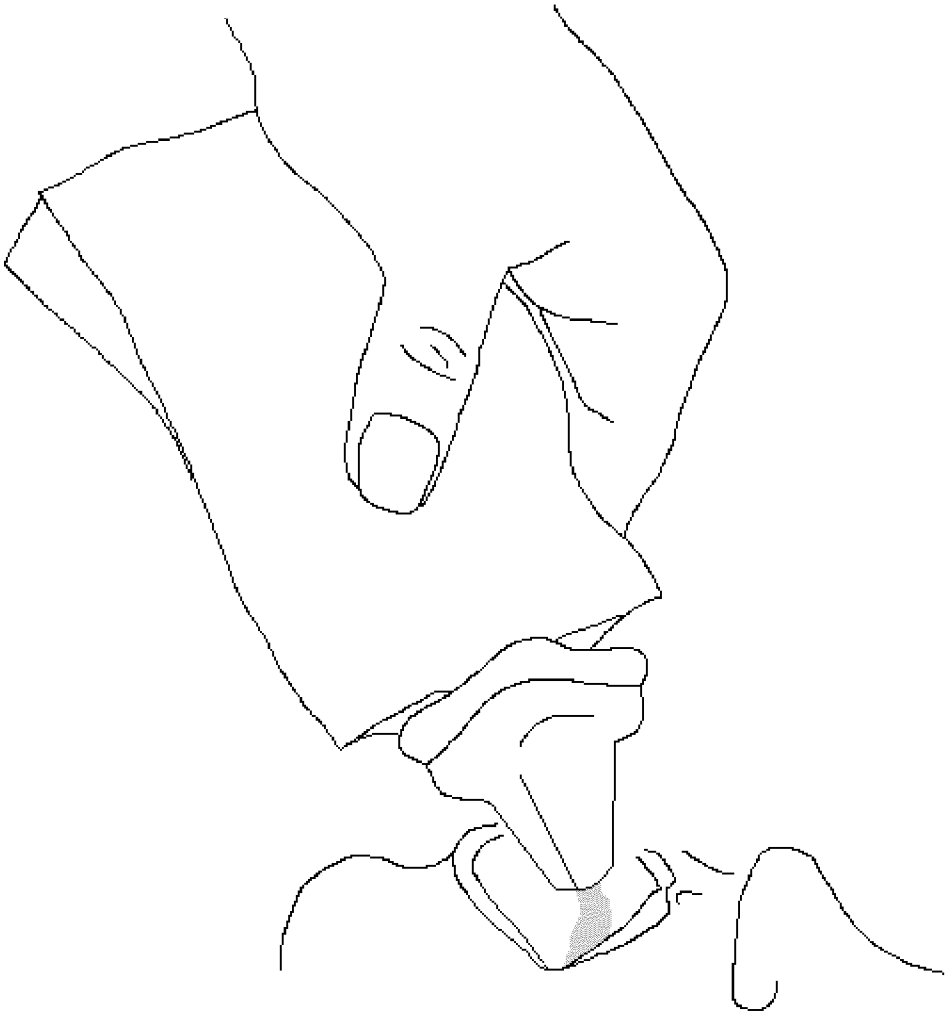
Figure 18:
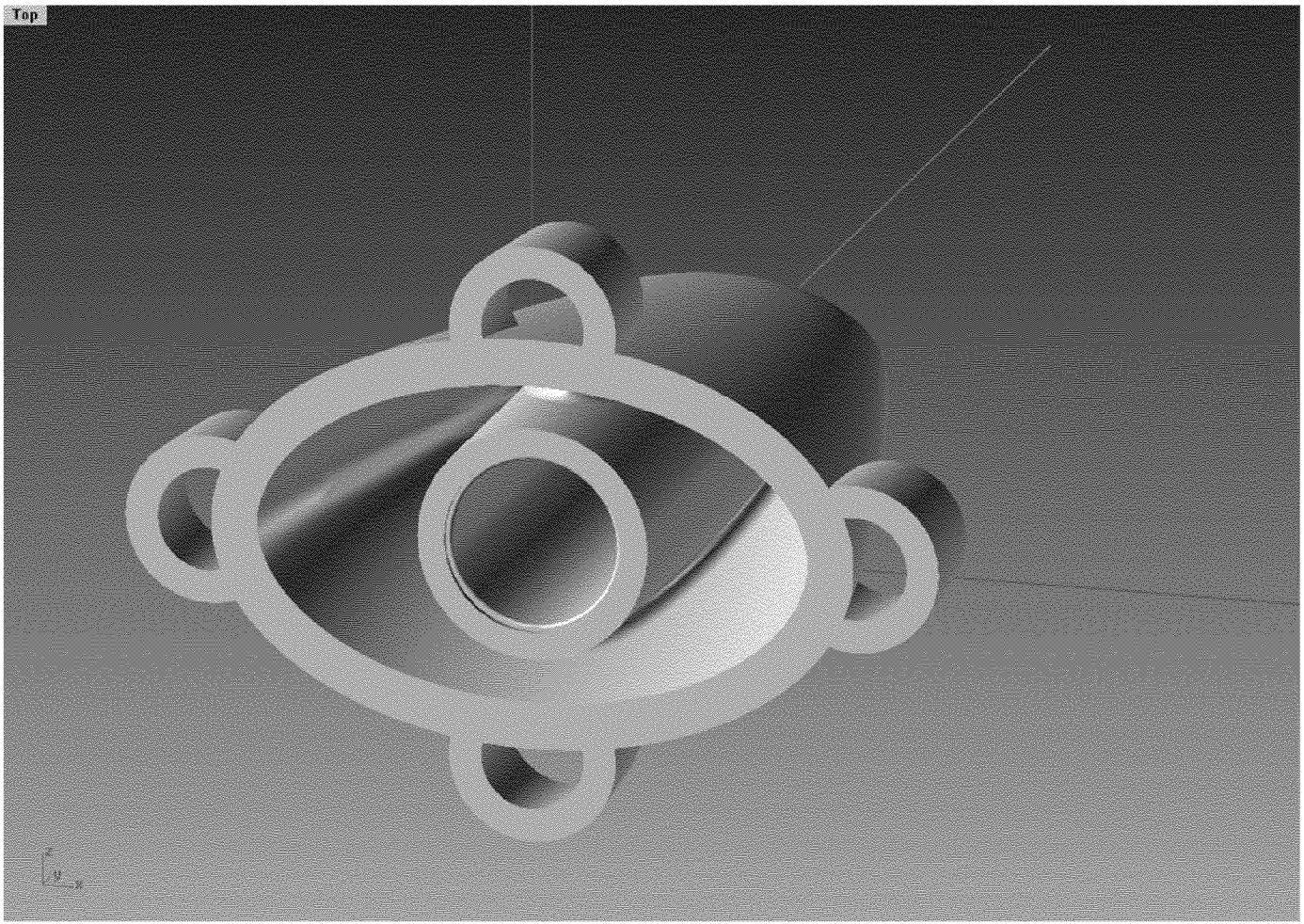
Figure 19:
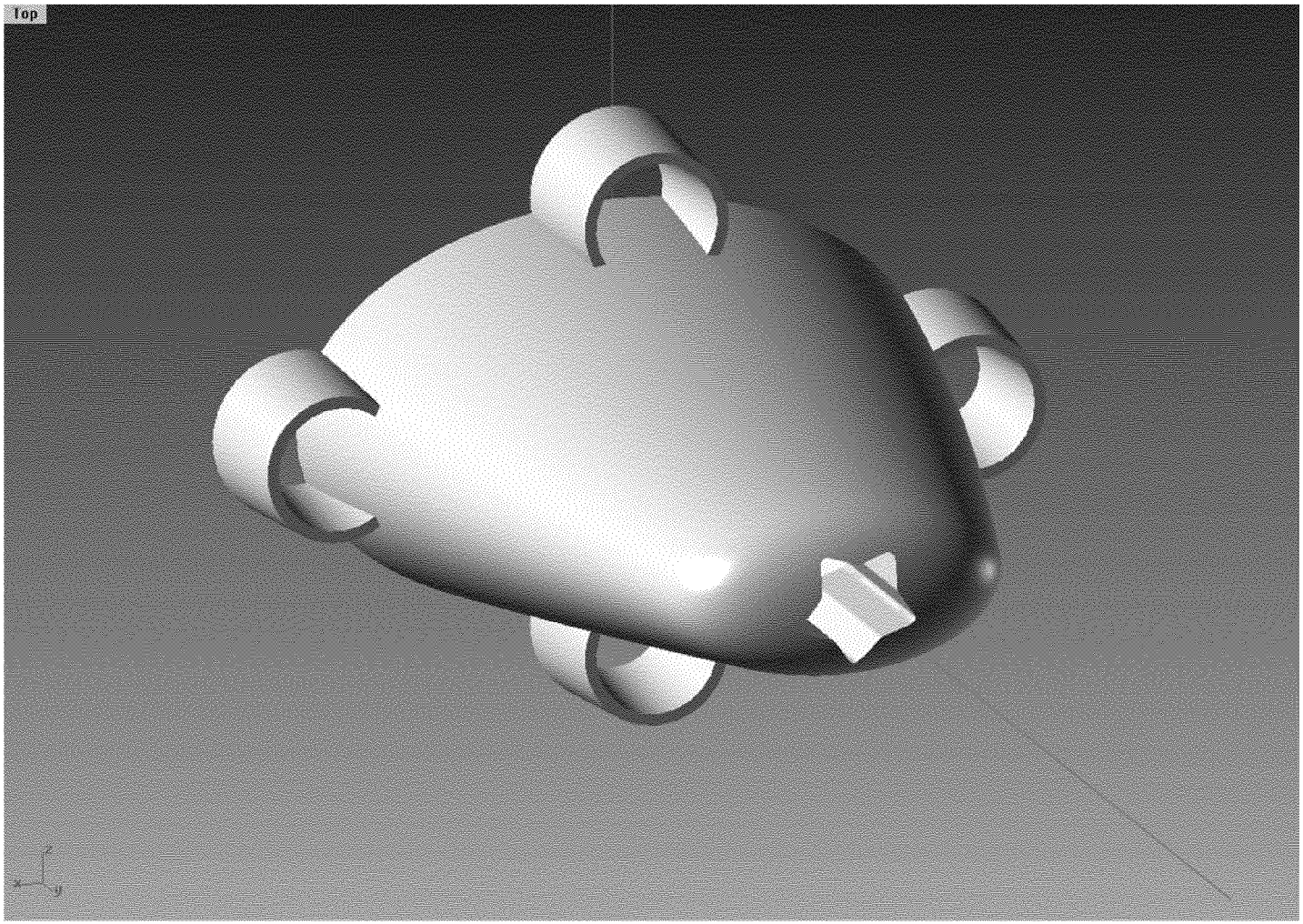
Figure 20:
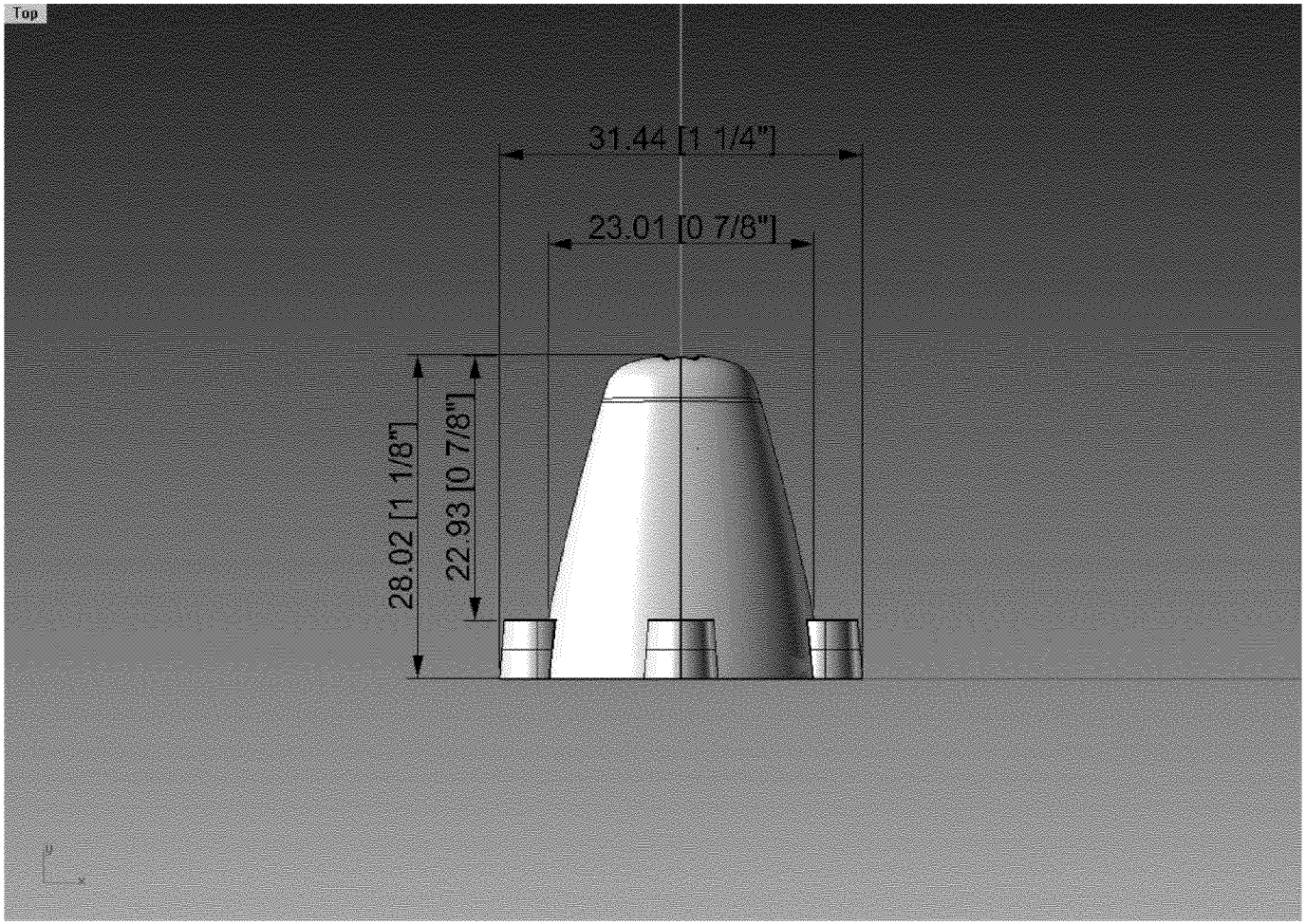
Figure 21:
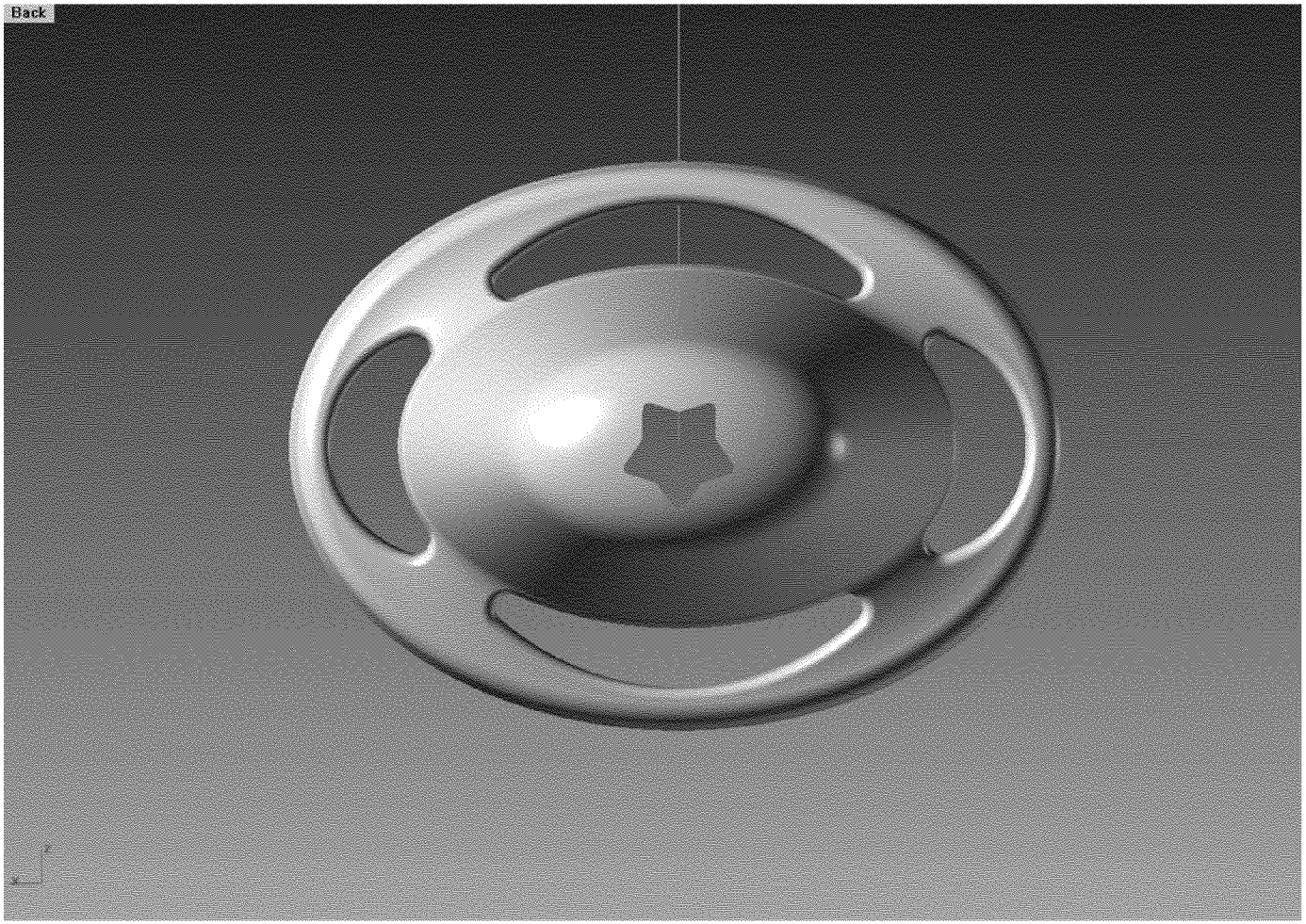
Figure 22:
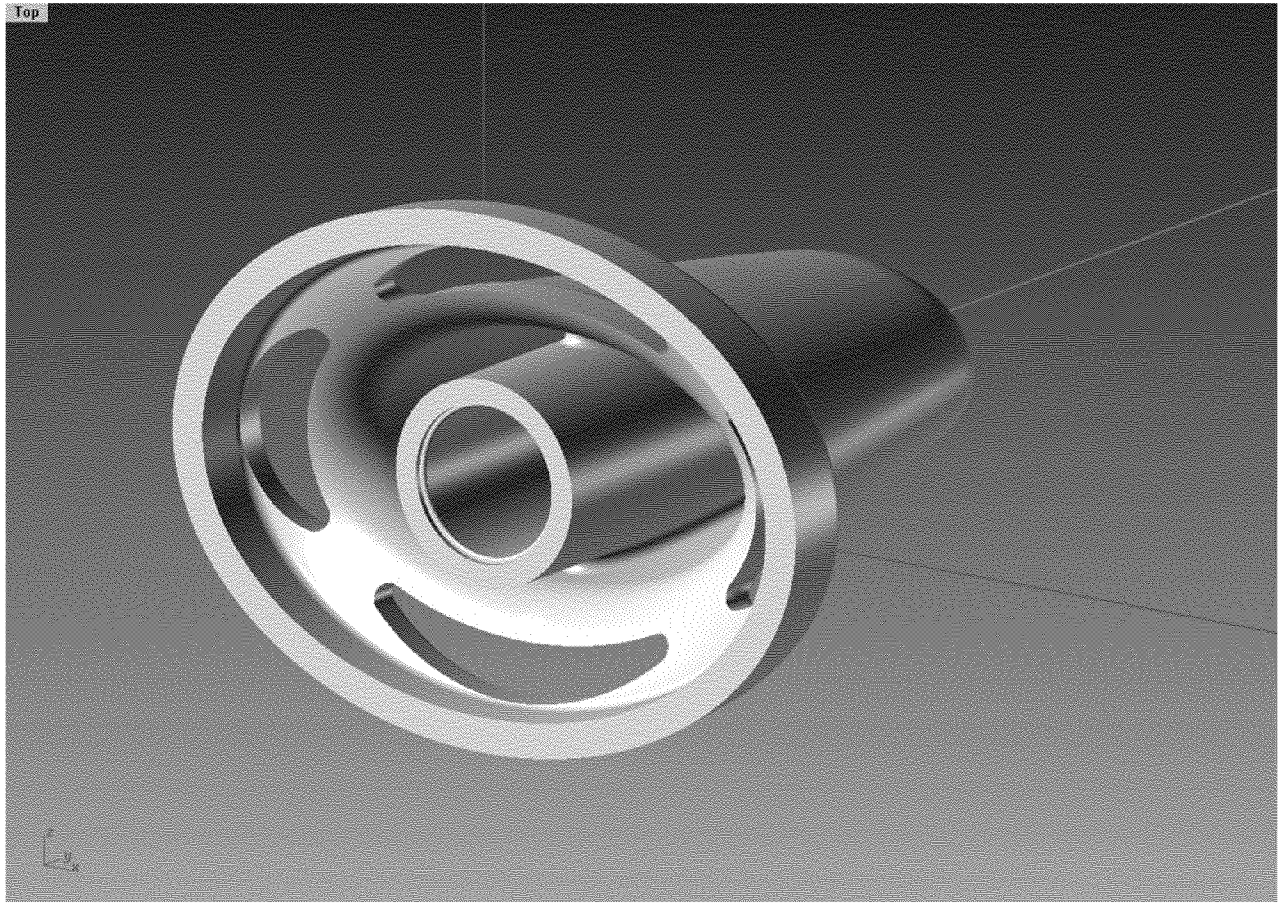
Figure 23:
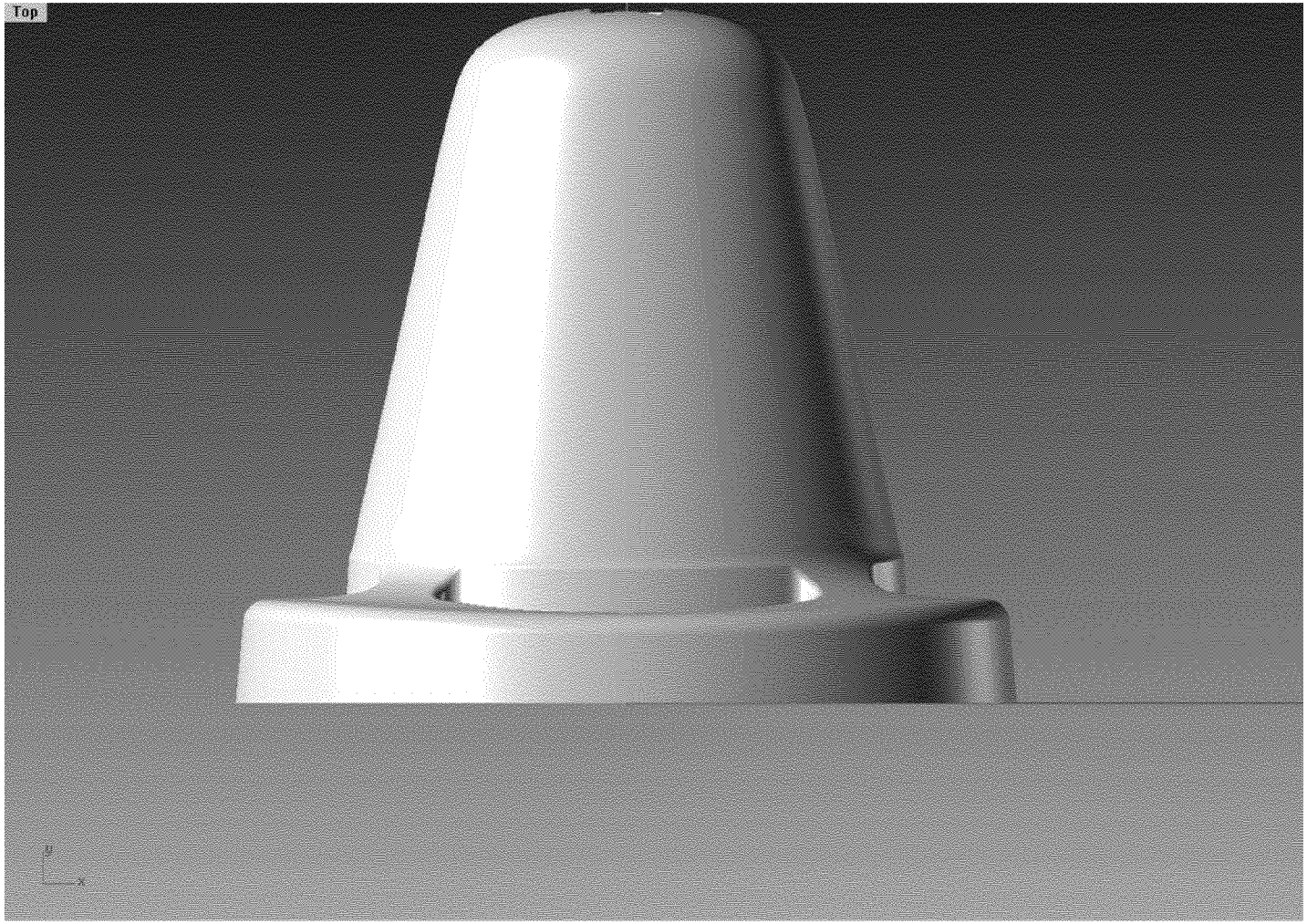

When viewed in its entirety, as shown in FIG. 17, the feeding apparatus attached to the pouch or container is a free standing product that may be manipulated with one hand. For example, to feed an infant, the system of apparatus and the container can be elevated to the mouth of the consumer, such that the feeding apparatus is inserted into the mouth of the consumer, at which point pressure can be applied to the pouch or food container. Then food can flow from the pouch or food container and through the feeding device into the consumer's mouth. Thus, the need for a separate food container and utensil can be eliminated, and the mess associated with traditional feeding can be minimized. Advantageously, the time necessary to feed the infant, toddler, or other individual who requires assistance is reduced and the feeding process is made convenient by allowing the caretaker to feed almost anywhere.

FIGS. 18-23 show additional views of implementations of the mouthpiece. For example, in the implementation shown in FIGS. 18-23 one or more rings can be included at the base of the mouthpiece to prevent choking if the mouthpiece is swallowed by a consumer.

While certain features of the described implementations have been illustrated as described herein, many modifications, substitutions, changes and equivalents will now occur to those skilled in the art. For example, a thin, flexible membrane can be included between the neck portion and the mouthpiece portion or between the container and the neck portion. The membrane may all material to pass from the container out through the mouthpiece when a certain amount of force is applied to the walls of the container, but otherwise the membrane may prevent or inhibit the passage of material from the container out through the mouthpiece to avoid spills of the material. It is, therefore, to be understood that the appended claims are intended to cover all such modifications and changes as fall within the scope of the embodiments.

What is claimed is:

1. An apparatus comprising:

a fitment configured to attach the apparatus substantially permanently with a flexible pouch containing edible material, wherein the fitment includes a first hole configured to provide an exit point for the edible material from the flexible pouch;

a neck portion configured to connect the fitment and a mouthpiece portion, wherein the neck portion includes a channel configured to transmit the edible material from the hole of the fitment to the mouthpiece; and a mouthpiece having a core material and a covering of material softer than the core material, the mouthpiece configured to facilitate eating of the edible material, wherein the mouthpiece includes: a concave portion configured to hold the edible material, and a second hole configured to transmit the edible material from the neck portion to the concave portion.

2. The apparatus of claim 1 wherein the mouthpiece is substantially shovel shaped.

3. The apparatus of claim 1 wherein the neck portion includes:

a non-moveable portion configured to be coupled with the fitment; and a moveable portion configured to be moved between a first position and a second position, wherein the moveable portion is configured to, when in the first position, substantially block the neck portion's channel such that substantially no edible material may be transmitted between the hole of the fitment to the mouthpiece, and wherein the moveable portion is configured to, when in the second position, substantially unblock the neck portion's channel such that edible material may be transmitted between the hole of the fitment to the mouthpiece.

4. The apparatus of claim 3 wherein the neck portion includes a safety indicator configured to indicate whether or not the neck has been moved from the first position to the second position since the apparatus has been manufactured.

5. The apparatus of claim 1 wherein the apparatus further includes a removable cap configured to cover the mouthpiece and the neck portion.

6. The apparatus of claim 1 wherein the mouthpiece second hole exit point includes a restraint configured to substantially block the second hole of the mouthpiece to limit transmission of edible material from the neck portion to the concave portion of the mouthpiece.

7. The apparatus of claim 1 wherein the mouthpiece is removable to provide access to a tamper-seal configured to render the apparatus useable and to indicate tampering with the apparatus.

8. The apparatus of claim 5 wherein the removable cap includes a leash coupled between the cap and the neck portion, and configured to keep the removable cap attached with the apparatus when the removable cap is removed from the mouthpiece.

9. The apparatus of claim 1 wherein the neck portion includes a removable tamper-seal configured to block the channel of the neck portion; wherein the mouthpiece is configured to be removable; and wherein the mouthpiece must be removed in order to remove the tamper-seal.

10. The apparatus of claim 1 wherein the apparatus includes:

a plastic wrap configured to substantially seal the mouthpiece and neck portions; and a pull-tab configured to facilitate the removal of the plastic wrap.

11. An apparatus comprising:

a fitment configured to attach to a container configured to hold semi-liquid material, wherein the fitment includes a spout configured to discharge the semi-liquid material from the container; and a mouthpiece removably attached to the fitment via a bump held in compression in a receiving groove so that the mouthpiece is removable from the fitment by movement of the mouthpiece with respect to the fitment to overcome compression of the bump into the groove, the mouthpiece including rings sized to prevent choking, a tubular hole configured to route the semi-liquid material from the spout to a holding portion of the mouthpiece, and the holding portion configured to hold the semi-liquid material that has been discharged from the container via the tubular hole; wherein the mouthpiecehaving a core material and a covering of material softer than the core material.

12. The apparatus of claim 11 wherein the mouthpiece includes a base end coupled with the fitment and a mouth end opposite the base; and wherein the base end includes a substantially rectangular cross section, and wherein the mouth end includes spoon shape with substantially smooth and rounded edges.

13. The apparatus of claim 11 wherein the fitment includes a removable seal semi-permanently attached to the spout; and configured to block the discharge of the semi-liquid material from the spout, and be removable once the mouthpiece is no longer coupled with the spout.

14. The apparatus of claim 11 wherein the mouthpiece is configured to be moved between:

an open position, a closed position; and wherein, when in the open position, the tubular hole is substantially open and the mouthpiece is extended, and wherein, when in the closed position, the tubular hole is substantially closed and the mouthpiece is compressed.

15. The apparatus of claim 14 wherein the mouthpiece includes a twist-open mouthpiece;

wherein the mouthpiece is configured to be placed into the open position by rotating the mouthpiece in a first direction; and wherein the mouthpiece is configured to be placed into the closed position by rotating the mouthpiece in a direction opposite to the first direction.

16. The apparatus of claim 14 wherein the mouthpiece includes a pop-open mouthpiece;

wherein the mouthpiece is configured to be placed into the open position by extending the mouthpiece along a longitudinal axis extending between the mouthpiece and the fitment; and wherein the mouthpiece is configured to be placed into the closed position by compressing the mouthpiece along the longitudinal axis.

17. The apparatus of claim 14 wherein the mouthpiece includes a tamper-proofing portion configured to indicate if the mouthpiece has been positioned in the open position since manufacture; and wherein the tamper-proofing portion is configured to be broken when the mouthpiece is first placed into the open position.

18. The apparatus of claim 1 wherein the mouthpiece includes:

a non-moveable portion configured to be coupled with the fitment; and a moveable flap configured to be moved between a first position and a second position, wherein the moveable flap is configured to, when in the first position, substantially block the mouthpiece's channel such that substantially no edible material may be transmitted between the hole of the fitment to the mouthpiece, and wherein the moveable flap is configured to, when in the second position, substantially unblock the mouthpiece's channel such that edible material may be transmitted between the hole of the fitment to the mouthpiece.

* * * * *